US010155294B2

(12) United States Patent
Seki et al.

(10) Patent No.: US 10,155,294 B2
(45) Date of Patent: Dec. 18, 2018

(54) POLISHING APPARATUS AND POLISHING METHOD

(71) Applicant: Ebara Corporation, Tokyo (JP)

(72) Inventors: Masaya Seki, Tokyo (JP); Tetsuji Togawa, Tokyo (JP); Kenya Ito, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 15/882,462

(22) Filed: Jan. 29, 2018

(65) Prior Publication Data

US 2018/0169822 A1 Jun. 21, 2018

Related U.S. Application Data

(62) Division of application No. 14/643,529, filed on Mar. 10, 2015, now Pat. No. 9,914,196.

(30) Foreign Application Priority Data

Mar. 14, 2014 (JP) ..... 2014-051013

(51) Int. Cl.
*B24B 49/00* (2012.01)
*B24B 21/00* (2006.01)
(Continued)

(52) U.S. Cl.
CPC ..... *B24B 21/002* (2013.01); *B24B 9/065* (2013.01); *B24B 21/00* (2013.01); *B24B 21/004* (2013.01);
(Continued)

(58) Field of Classification Search
CPC ..... B24B 21/00; B24B 21/002; B24B 21/02; B24B 49/00
(Continued)

(56) References Cited

U.S. PATENT DOCUMENTS 6,402,596 B1 6/2002 Hakomori et al.
6,878,630 B2 * 4/2005 Bang ..... H01L 21/02008 257/E21.214
(Continued)

FOREIGN PATENT DOCUMENTS

JP S62-152638 A 7/1987
JP H08-1494 A 1/1996
(Continued)

OTHER PUBLICATIONS

Japanese Patent Office, Decision to Grant a Patent in Japanese Patent Application No. 2014-051013 (Sep. 5, 2017).

*Primary Examiner* — Eileen Morgan
(74) *Attorney, Agent, or Firm* — Leydig, Voit & Mayer, Ltd.

(57) ABSTRACT

A polishing unit of a polishing apparatus according to an embodiment includes: a polishing head having a pressing member configured to hold a polishing tape and press the polishing tape against a peripheral portion of a substrate from above; a tape supply and recovery mechanism configured to supply the polishing tape to the polishing head and recover the polishing tape from the polishing head; a first moving mechanism configured to move the polishing head in a radial direction of the substrate; and a second moving mechanism configured to move the tape supply and recovery mechanism in the radial direction of the substrate. The positioning unit includes a positioning block having a contacting surface, and alignment of the polishing tape is conducted by the second moving mechanism moving the tape supply and recovery mechanism so that a substrate-side edge of the polishing tape makes contact with the contacting surface.

5 Claims, 28 Drawing Sheets

(51) Int. Cl.
*B24B 21/02* (2006.01)
*B24B 27/00* (2006.01)
*B24B 49/12* (2006.01)
*B24B 9/06* (2006.01)

(52) U.S. Cl.
CPC ..... *B24B 21/02* (2013.01); *B24B 27/0076* (2013.01); *B24B 49/00* (2013.01); *B24B 49/12* (2013.01)

(58) Field of Classification Search
USPC ..... 451/9, 10, 11, 307
See application file for complete search history.

(56) References Cited

U.S. PATENT DOCUMENTS 6,913,520 B1 * 7/2005 Liao ..... B24B 37/042 451/41
7,351,131 B2 * 4/2008 Nakamura ..... B24B 9/065 257/E21.237
7,367,873 B2 * 5/2008 Ishii ..... B24B 9/065 451/168
7,621,799 B2 * 11/2009 Sakairi ..... H01L 21/02024 451/299
2001/0014570 A1 * 8/2001 Wenski ..... B24B 9/065 451/41
2002/0077039 A1 * 6/2002 Wenski ..... H01L 21/02024 451/41
2006/0094343 A1 * 5/2006 Sato ..... B24B 9/065 451/313
2007/0131654 A1 * 6/2007 Wasinger ..... B24B 1/04 216/88
2008/0026185 A1 * 1/2008 Mizushima ..... B24B 9/065 428/157
2008/0200100 A1 * 8/2008 Takahashi ..... B24B 9/065 451/44
2008/0293336 A1 * 11/2008 Zhang ..... B24B 9/065 451/44
2009/0142992 A1 * 6/2009 Takahashi ..... B24B 9/065 451/9
2009/0247055 A1 * 10/2009 Erk ..... H01L 21/02019 451/44
2009/0264053 A1 * 10/2009 Manens ..... B24B 9/065 451/59
2010/0105294 A1 * 4/2010 Ettinger ..... B24B 9/065 451/44
2011/0136411 A1 * 6/2011 Nakanishi ..... B24B 9/065 451/41
2011/0237164 A1 * 9/2011 Seki ..... B24B 9/065 451/44
2011/0256811 A1 * 10/2011 Nakanishi ..... B24B 9/065 451/41
2012/0135668 A1 * 5/2012 Nakanishi ..... B24B 21/002 451/28
2012/0244787 A1 * 9/2012 Seki ..... B24B 9/065 451/303
2012/0252320 A1 10/2012 Seki et al.
2013/0115861 A1 * 5/2013 Priewasser ..... H01L 21/304 451/54
2014/0187126 A1 * 7/2014 Nakanishi ..... H01L 21/02057 451/44
2015/0235858 A1 * 8/2015 Lee ..... H01L 21/02057 438/5

FOREIGN PATENT DOCUMENTS

JP 2001-025953 A 1/2001
JP 2001-205549 A 7/2001
JP 2004-345029 A 12/2004
JP 2009-154285 7/2009
JP 2012-213849 11/2012

* cited by examiner

POLISHING APPARATUS AND POLISHING METHOD

CROSS-REFERENCE TO RELATED APPLICATIONS

This application is based upon and claims the benefit of priority from Japanese Patent Application No. 2014-051013, filed on Mar. 14, 2014, the disclosure of which is incorporated herein in its entirety by reference.

FIELD

The present technique relates to a polishing apparatus and a polishing method for polishing a peripheral portion of a substrate, such as a semiconductor wafer, and more particularly to a polishing apparatus and a polishing method for polishing a peripheral portion of a substrate by pressing a polishing tape against the peripheral portion of the substrate.

BACKGROUND AND SUMMARY

From a viewpoint of improving the yield in fabrication of semiconductor devices, management of surface conditions of a peripheral portion of a substrate has been attracting attention in recent years. In the fabrication process of the semiconductor devices, various materials are deposited on a silicon wafer. As a result, unwanted films and rough surfaces are formed on a peripheral portion of the substrate. It has been a recent trend to transport the substrate by holding only its peripheral portion using arms. Under such circumstances, the unwanted films remaining on the peripheral portion may peel off during various processes and may adhere to devices formed on the substrate, thus decreasing the yield. Thus, in order to remove the unwanted films formed on the peripheral of the substrate, the peripheral portion of the substrate is polished using a polishing apparatus.

This type of polishing apparatus polishes the peripheral portion of the substrate by bringing a polishing surface of a polishing tape into sliding contact with the peripheral portion of the substrate. In this specification, the peripheral portion is defined as a region including a bevel portion which is the outermost portion of the substrate and a top edge portion and bottom edge portion located on the inner side in the radial direction of the bevel portion.

FIGS. 1A and 1B are enlarged cross-sectional views each illustrating a peripheral portion of a substrate W. More specifically, FIG. 1A illustrates a cross-sectional view of a so-called straight-type substrate, and FIG. 1B illustrates a cross-sectional view of a so-called round-type substrate. In the substrate W illustrated in FIG. 1A, the bevel portion is an outermost circumferential surface of the substrate W (indicated by symbol B) that is constituted by an upper slope (an upper bevel portion) P, a lower slope (a lower bevel portion) Q, and a side portion (an apex) R. In the substrate W illustrated in FIG. 1B, the bevel portion is a portion B having a curved cross-section and forming an outermost circumferential surface of the substrate W. The top edge portion is a flat portion E1 located on the inner side in a radial direction of the bevel portion B and located on the outer side in the radial direction of a region D where devices are formed. The bottom edge portion is a flat portion E2 located opposite to the top edge portion and located on the inner side in the radial direction of the bevel portion B. These top edge portion E1 and bottom edge portion E2 may be collectively referred to as near-edge portions.

A conventional polishing apparatus (for example, see JP 2012-213849 A) that polishes a peripheral portion of a substrate by pressing a polishing tape against the peripheral portion of the substrate includes a substrate holder configured to hold and rotate a substrate and at least one polishing unit configured to polish the peripheral portion of the substrate. This polishing unit includes a polishing head having a pressing member configured to press a polishing tape against the peripheral portion of the substrate from above, and a tape supply and recovery mechanism configured to supply the polishing tape to the polishing head and to recover the polishing tape from the polishing head. The polishing head can move in a radial direction of the substrate with the aid of a first moving mechanism, and the tape supply and recovery mechanism can move in the radial direction of the substrate with the aid of a second moving mechanism. The tape supply and recovery mechanism has a plurality of guide rollers for supporting the polishing tape, and the plurality of guide rollers are arranged such that the polishing tape extends in parallel to a tangential direction of the substrate and a polishing surface of the polishing tape is in parallel to a surface of the substrate. During polishing, liquid (for example, pure water) is supplied to the center of the rotating substrate so that the substrate is polished in the presence of the water. The liquid supplied to the substrate spreads over the entire upper surface of the substrate by a centrifugal force.

The polishing tape is a long and narrow strip-shaped polishing tool. Although a width of the polishing tape is basically constant throughout its entire length, there may be a slight variation in the width of the polishing tape in some parts thereof. Therefore, whenever the polishing tape is sent by the tape supply and recovery mechanism to provide a new polishing surface under the pressing member, the position of the edge of the polishing tape at the polishing position where the polishing tape is pressed against the pressing member may vary. Thus, the polishing apparatus includes a polishing tape-edge detection sensor that detects the position of an edge of the polishing tape in order to align the edge of the polishing tape with the edge of the pressing member.

FIGS. 2A to 2C are views illustrating an operation of detecting the edge of a polishing tape 38 using a tape-edge detection sensor 100. Prior to polishing of a substrate W, the polishing tape 38 supported on a tape supply and recovery mechanism 70 is moved from a retracted position illustrated in FIG. 2A to a tape-edge detecting position illustrated in FIG. 2B. In this tape-edge detecting position, the position of the substrate-side edge of the polishing tape 38 is detected by the tape-edge detection sensor 100. This tape-edge detection sensor 100 is a transmission optical sensor. The tape-edge detection sensor 100 has a light emitter 100A and a light receiver 100B. This tape-edge detection sensor 100 is configured to emit light from the light emitter 100A to the light receiver 100B and to detect the position of the edge of the polishing tape 38 based on a quantity of the light received by the light receiver 100B. After that, as illustrated in FIG. 2C, the polishing tape 38 is moved to a polishing position by the second moving mechanism so that the edge of the polishing tape 38 coincides with the edge of a pressing member 51.

As described above, although liquid is supplied to the center of the rotating substrate W during polishing and the liquid spreads over the entire upper surface of the substrate W by a centrifugal force, the liquid may become water droplets which may adhere to the polishing tape 38. Thus, when water droplets adhere to the edge portion, in particular, of the polishing tape 38, the light projected from the light transmitter 100A of the tape-edge detection sensor 100 may scatter by the water droplets, and as a result, the light that is to enter the light receiver 100B may not enter the light receiver 100B correctly. Thus, it is difficult to detect the edge of the polishing tape 38 accurately using the tape-edge detection sensor 100 and the positional accuracy of the polishing tape 38 decreases. Moreover, in order to prevent a decrease in the positional accuracy caused by such water droplets, it is necessary to remove the water droplets using air nozzle or the like so that water droplets do not adhere to the polishing tape 38. As a result, the apparatus configuration becomes complex.

With the foregoing in view, an object of the present application is to provide a polishing apparatus capable of positioning the polishing tape with high accuracy.

According to an embodiment, there is provided a polishing apparatus including: at least one polishing unit configured to polish an edge portion of a substrate; and a positioning unit, wherein the polishing unit includes: a polishing head having a pressing member configured to absorb a polishing tape and press the polishing tape against a peripheral portion of the substrate from above; a tape supply and recovery mechanism configured to supply the polishing tape to the polishing head and recover the polishing tape from the polishing head; a first moving mechanism configured to move the polishing head in a radial direction of the substrate; and a second moving mechanism configured to move the tape supply and recovery mechanism in the radial direction of the substrate, the positioning unit includes a positioning block having a contacting surface, and alignment of the polishing tape is conducted by the second moving mechanism moving the tape supply and recovery mechanism so that a substrate-side edge of the polishing tape makes contact with the contacting surface.

According to this configuration, since alignment of the polishing tape for allowing the polishing tape to be adsorbed to the pressing member is conducted according to a mechanical method of bringing the substrate-side edge of the polishing tape into contact with the contacting surface, it is possible to conduct alignment of the polishing tape without using an optical sensor in alignment of the polishing tape. Here, the radial direction of the substrate is a radial direction of the substrate at a polishing position when the edge portion of the substrate is polished by the polishing tape.

In the polishing apparatus, the pressing member may adsorb the polishing tape being in contact with the contacting surface. With this configuration, since the polishing tape being aligned in a state of being in contact with the contacting surface is adsorbed by the pressing member, it is possible to conduct alignment between the polishing tape and the pressing member with high accuracy.

In the polishing apparatus, a substrate-side edge of the pressing member and the substrate-side edge of the polishing tape may be aligned by moving the polishing head so that the substrate-side edge of the pressing member makes contact with the contacting surface. With this configuration, alignment can be conducted so that the substrate-side edges of the pressing member and the polishing tape are aligned.

In the polishing apparatus, the positioning unit may further include a position sensor having a distal end that protrudes from the contacting surface of the positioning block and is configured to detect an amount of protrusion of the distal end, and the first moving mechanism may move the polishing head to press the distal end of the position sensor with the substrate-side edge of the pressing member to thereby conduct alignment of the pressing member based on the detected amount of protrusion. With this configuration, alignment between the polishing tape and the pressing member can be conducted by setting the position of the pressing member in relation to the polishing tape in the radial direction of the substrate in an arbitrary manner.

In the polishing apparatus, the positioning unit may further include a third moving mechanism configured to move the positioning block in the radial direction of the substrate, and the third moving mechanism may move the positioning block so that the contacting surface coincides with an inner edge of the edge portion of the substrate. With this configuration, by realizing alignment of the polishing tape and/or the pressing member, the alignment of the polishing tape and/or the pressing member in the radial direction of the substrate can be also conducted.

The polishing apparatus may further include a polishing-unit moving mechanism configured to move the polishing unit in a tangential direction of the substrate. With this configuration, after the alignment of the polishing tape and/or the pressing member in the radial direction of the substrate is conducted at the tape alignment position, the polishing unit can be moved to the polishing position. Here, the tangential direction of the substrate is a tangential direction of the substrate at a polishing position when the edge portion of the substrate is polished by the polishing tape.

According to an embodiment, there is provided a polishing method including: rotating a substrate; aligning a polishing tape by bringing a substrate-side edge of the polishing tape into contact with a contacting surface; allowing the aligned polishing tape to be adsorbed on a pressing member; and pressing the polishing tape against a peripheral portion of the substrate using the pressing member to thereby polish the peripheral portion of the substrate. With this configuration, since alignment of the polishing tape for allowing the polishing tape to be adsorbed to the pressing member is conducted according to a mechanical method of bringing the polishing tape into contact with the contacting surface, it is possible to conduct alignment of the polishing tape without using an optical sensor in alignment of the polishing tape.

In the polishing method, the pressing member may adsorb the polishing tape being in contact with the contacting surface. With this configuration, since the polishing tape being aligned in a state of being in contact with the contacting surface is adsorbed by the pressing member, it is possible to conduct alignment between the polishing tape and the pressing member with high accuracy.

In the polishing method, after adsorbing the polishing tape, the pressing member may move to a polishing position in a state of adsorbing the polishing tape to polish the peripheral portion of the substrate at the polishing position. With this configuration, the polishing tape can be adsorbed to the pressing member at a position different from the polishing position.

In the polishing method, the pressing member may be aligned by bringing a substrate-side edge of the pressing member into contact with the contacting surface, and the pressing member may adsorb the polishing tape in a state of being in contact with the contacting surface. With this configuration, since alignment is conducted by bringing the polishing tape and the pressing member into the same contacting surface, the substrate-side edges of the polishing tape and the pressing member can be aligned.

In the polishing method, a position of the pressing member may be detected using a position sensor and the pressing member may be aligned based on a detection value of the position sensor, and the pressing member may adsorb the polishing tape at the aligned position. With this configuration, the polishing tape and the pressing member when the pressing member adsorbs the polishing tape may be in an optional positional relation.

In the polishing method, the pressing member may adsorb the polishing tape in such a positional relation that the substrate-side edge of the polishing tape is shifted closer to the substrate than the substrate-side edge of the pressing member. With this configuration, a tape allowance of the polishing tape is secured.

BRIEF DESCRIPTION OF THE DRAWINGS

FIGS. 20 A2, 20 B2, 20 C2, 20 D2, and 20 E2 are plan views illustrating a positional relation among a substrate, a positioning block, a pressing member, and a polishing tape;

FIGS. 22 A2, 22 B2, 22 C2, 22 D2, and 22 E2 are plan views illustrating a positional relation among a substrate, a positioning block, a pressing member, and a polishing tape;

DETAILED DESCRIPTION OF NON-LIMITING EXAMPLE EMBODIMENTS

Hereinafter, embodiments of the present invention will be described below with reference to the drawings. The embodiments described below are examples in which the present technique is implemented, and the present technique is not limited to the specific configuration described below. In implementation of the present technique, a specific configuration may be appropriately employed depending on an embodiment.

Figure 3:
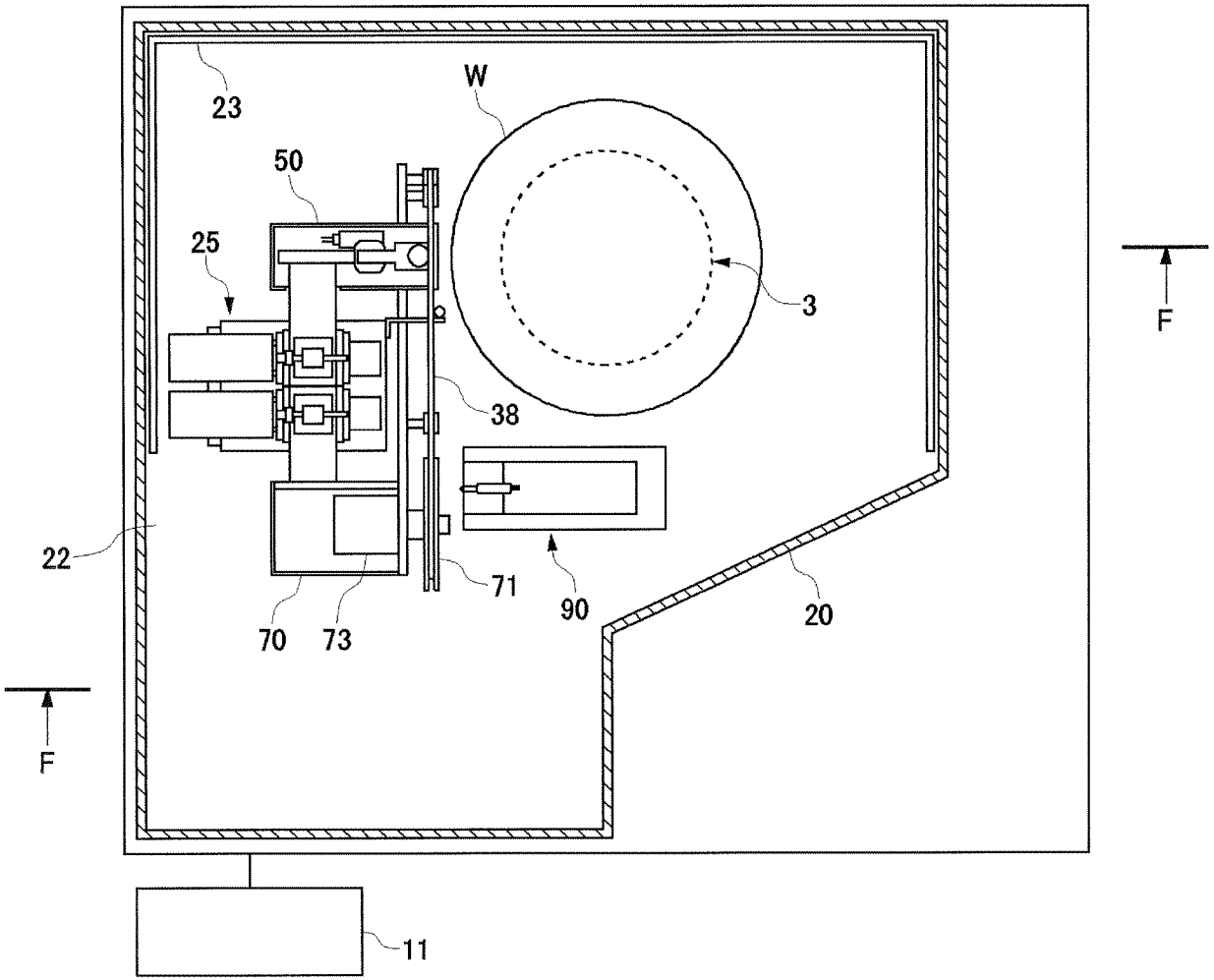
FIG. 3 is a plan view illustrating a configuration of a polishing apparatus according to an embodiment.
Figure 4:
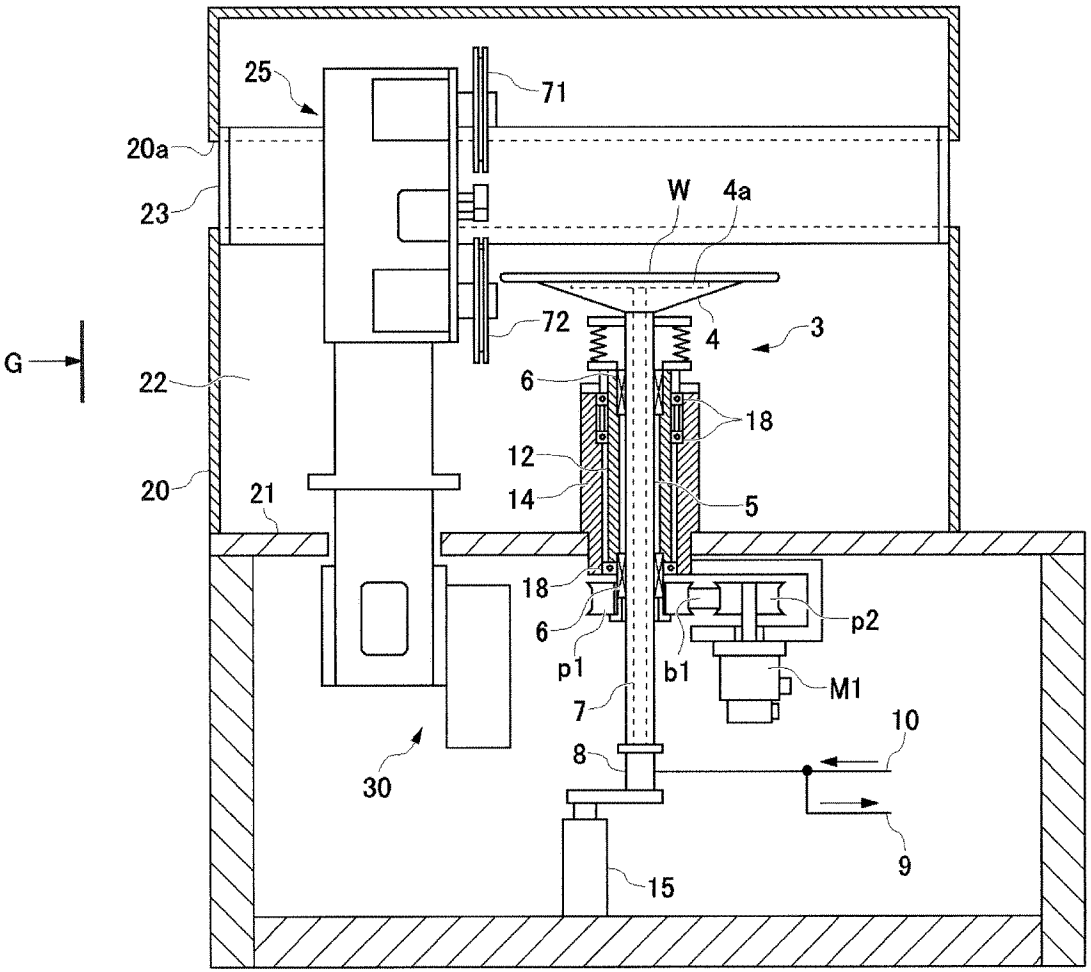
FIG. 4 is a cross-sectional view taken along line F-F in FIG. 3.
Figure 5:
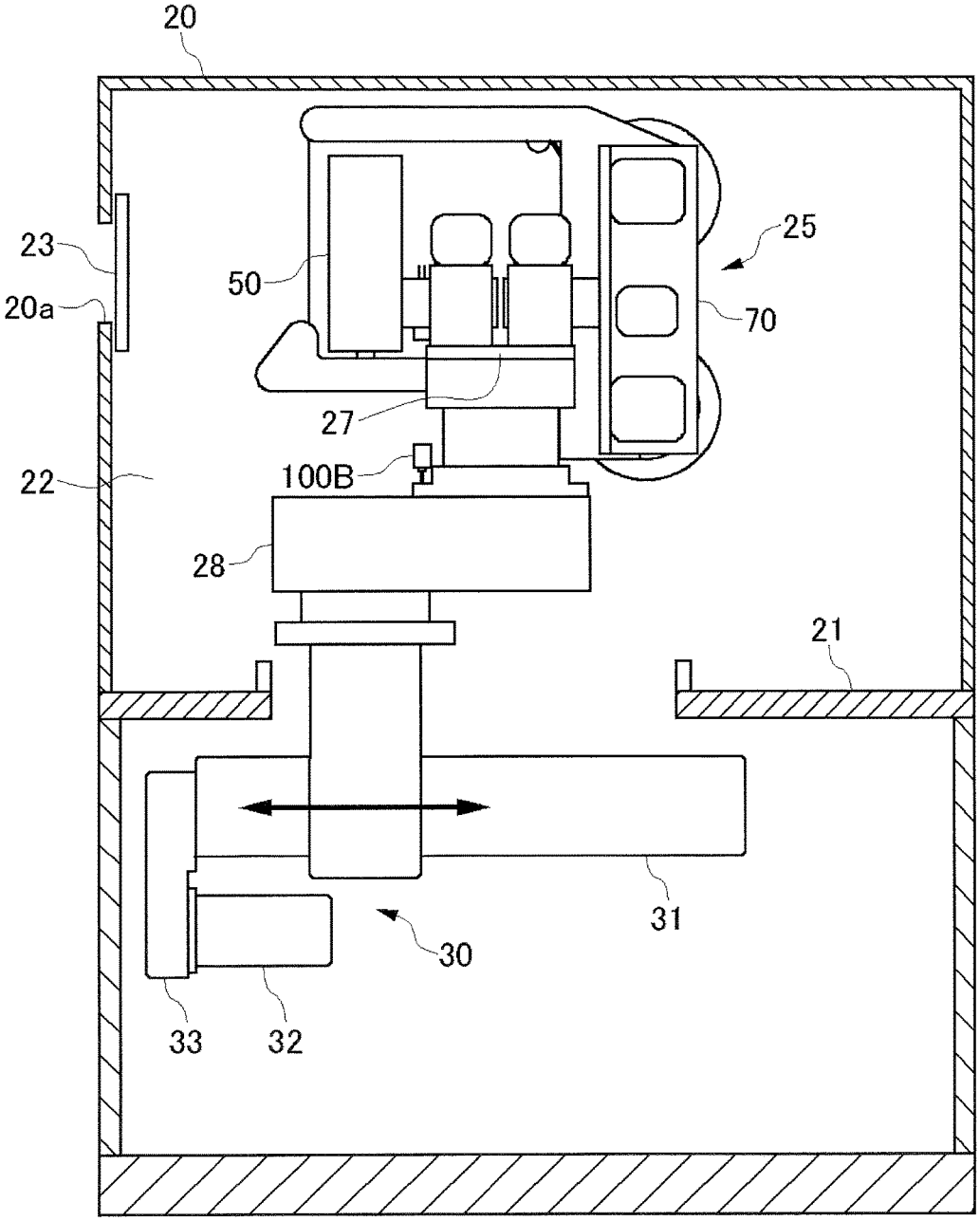
FIG. 5 is a view from a direction indicated by arrow G in FIG. 4.

FIG. 3 is a plan view illustrating a polishing apparatus according to an embodiment of the present invention, FIG. 4 is a cross-sectional view taken along line F-F in FIG. 3, and FIG. 5 is a view from a direction indicated by arrow G in FIG. 4.

The polishing apparatus according to the embodiment includes a substrate holder 3 configured to hold a substrate W (that is, a workpiece to be polished) horizontally and to rotate the substrate W. FIGS. 3 and 4 illustrate a state in which the substrate holder 3 holds the substrate W. This substrate holder 3 has a holding stage 4 configured to hold a lower surface of the substrate W by a vacuum suction, a hollow shaft 5 coupled to a central portion of the holding stage 4, and a motor M1 for rotating the hollow shaft 5. The substrate W is placed onto the holding stage 4 such that a center of the substrate W is aligned with a central axis of the hollow shaft 5. The holding stage 4 is located in a polishing chamber 22 that is defined by a partition 20 and a base plate 21.

The hollow shaft 5 is supported by ball spline bearings (that is, linear motion bearings) 6 which allow the hollow shaft 5 to move vertically. The holding stage 4 has an upper surface with grooves 4*a*. These grooves 4*a* communicate with a communication passage 7 extending through the hollow shaft 5. The communication passage 7 is coupled to a vacuum line 9 via a rotary joint 8 provided on a lower end of the hollow shaft 5. The communication passage 7 is also coupled to a nitrogen-gas supply line 10 for use in releasing the substrate W from the holding stage 4 after processing. By selectively coupling the vacuum line 9 and the nitrogen-gas supply line 10 to the communication passage 7, the substrate W can be held on the upper surface of the holding stage 4 and can be released from the upper surface of the holding stage 4.

A pulley p1 is coupled to the hollow shaft 5, and a pulley p2 is mounted on a rotational shaft of the motor M1. The hollow shaft 5 is rotated by the motor M1 through the pulley p1, the pulley p2, and a belt b1 riding on these pulleys p1 and p2. The ball spline bearing 6 is a bearing that allows the hollow shaft 5 to move freely in its longitudinal direction. The ball spline bearings 6 are secured to a cylindrical casing 12. Therefore, the hollow shaft 5 can move linearly up and down relative to the casing 12, and the hollow shaft 5 and the casing 12 rotate in unison. The hollow shaft 5 is coupled to an air cylinder (elevating mechanism) 15, so that the hollow shaft 5 and the holding stage 4 are elevated and lowered by the air cylinder 15.

A cylindrical casing 14 is provided so as to surround the casing 12 in a coaxial arrangement. Radial bearings 18 are provided between the casing 12 and the casing 14, so that the casing 12 is rotatably supported by the radial bearings 18. With such a configuration, the substrate holder 3 can rotate the substrate W about its central axis and can elevate and lower the substrate W along the central axis.

A polishing unit 25 for polishing a peripheral portion of the substrate W is provided on the outer side in the radial direction of the substrate W held by the substrate holder 3. This polishing unit 25 is located in the polishing chamber 22. As illustrated in FIG. 5, the polishing unit 25 in its entirety is secured to a mount base 27. The mount base 27 is coupled to a polishing-unit moving mechanism 30 via an arm block 28.

The polishing-unit moving mechanism 30 has a ball screw mechanism 31 that slidably holds the arm block 28, a motor 32 for driving the ball screw mechanism 31, and a power transmission mechanism 33 that couples the ball screw mechanism 31 and the motor 32 to each other. The power transmission mechanism 33 is constructed by pulleys, a belt, and the like. As the motor 32 operates, the ball screw mechanism 31 moves the arm block 28 in directions indicated by arrows in FIG. 5 to thereby move the polishing unit 25 in its entirety in a tangential direction of the substrate W. This polishing-unit moving mechanism 30 also serves as an oscillation mechanism for oscillating the polishing unit 25 at a predetermined amplitude and a predetermined speed.

The polishing unit 25 includes a polishing head 50 for polishing the periphery of the substrate W using a polishing tape 38, and a polishing-tape supply and recovery mechanism 70 for supplying the polishing tape 38 to the polishing head 50 and recovering the polishing tape 38 from the polishing head 50. The polishing head 50 is a top-edge polishing head for polishing the top edge portion of the substrate W by pressing a polishing surface of the polishing tape 38 against the peripheral portion of the substrate W from above.

Figure 6:
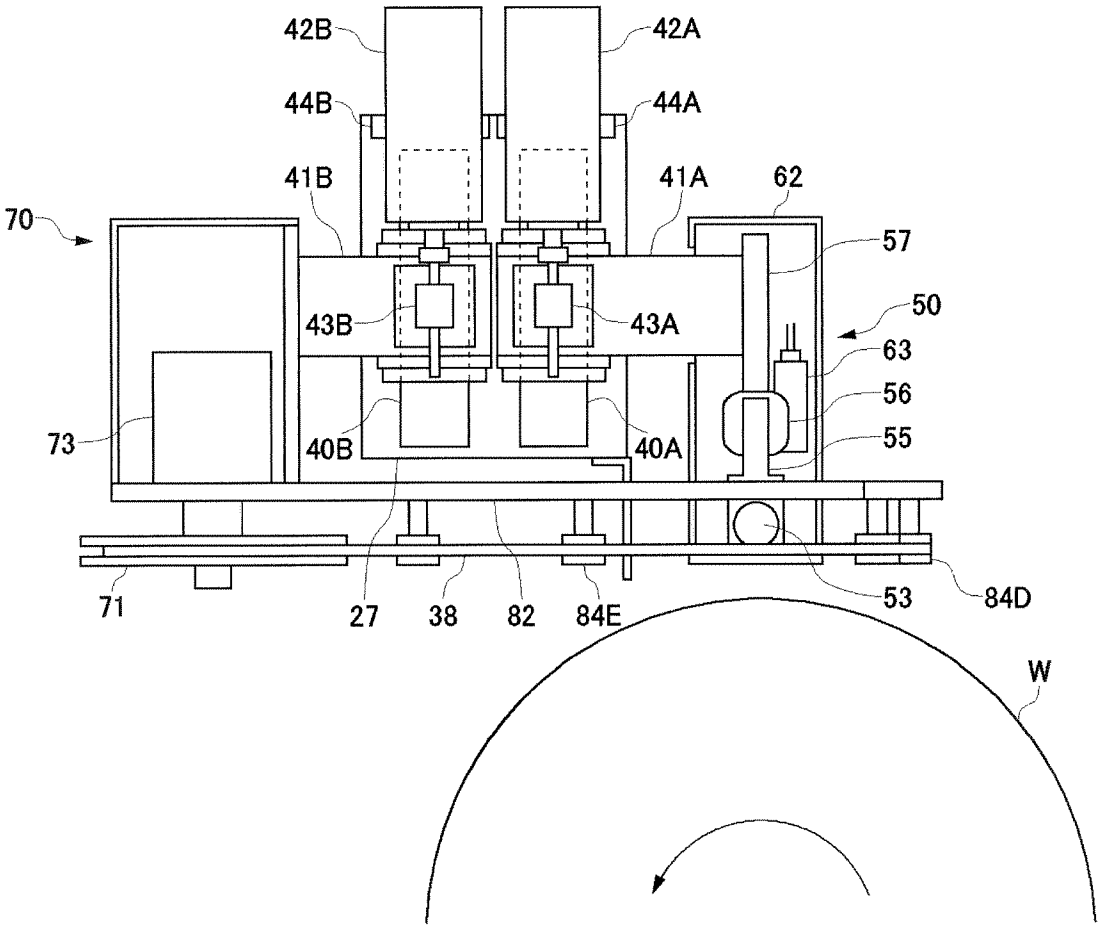
FIG. 6 is a plan view of a polishing head and a polishing-tape supply and recovery mechanism according to an embodiment.
Figure 7:
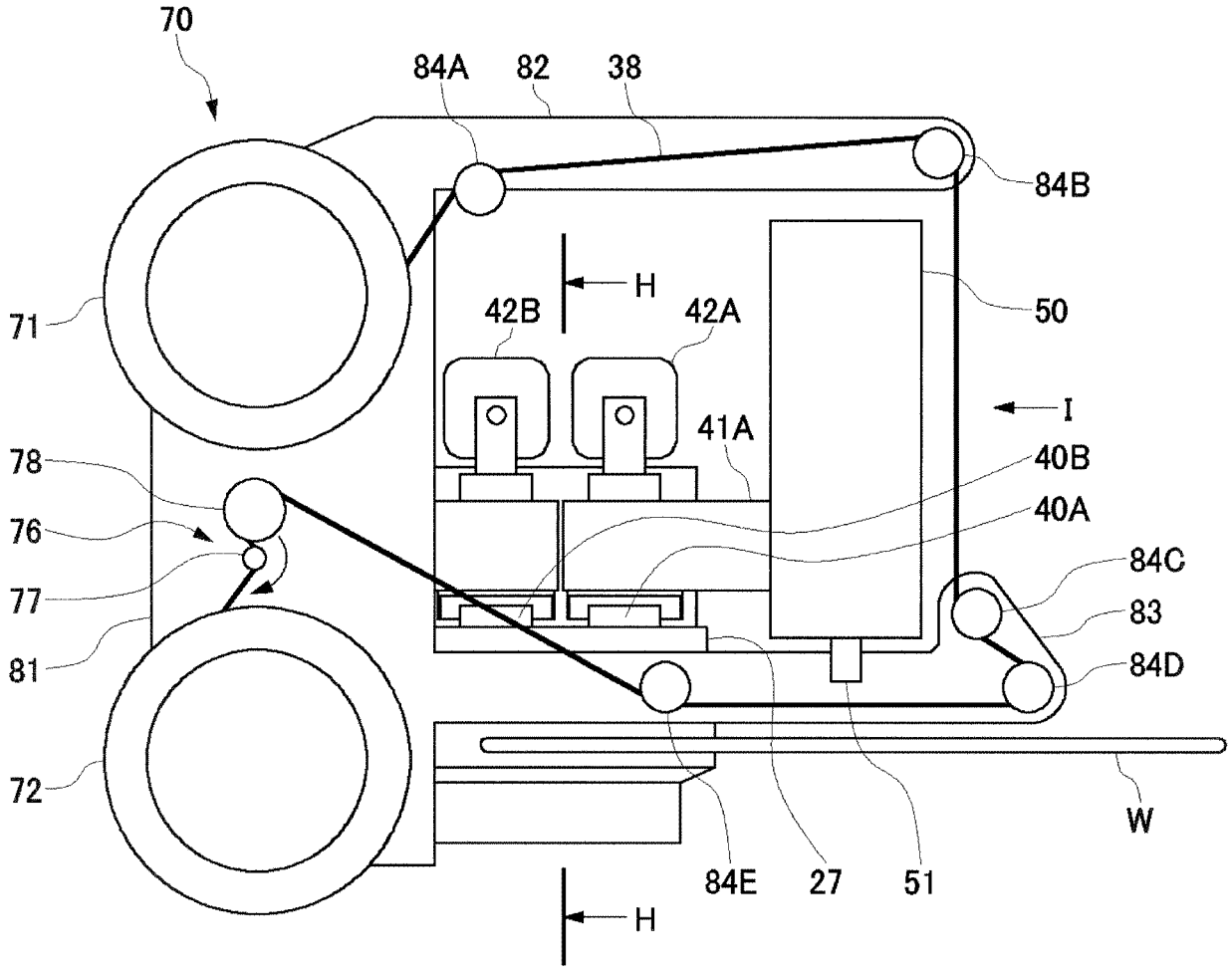
FIG. 7 is a front view of the polishing head and the polishing-tape supply and recovery mechanism according to an embodiment.
Figure 8:
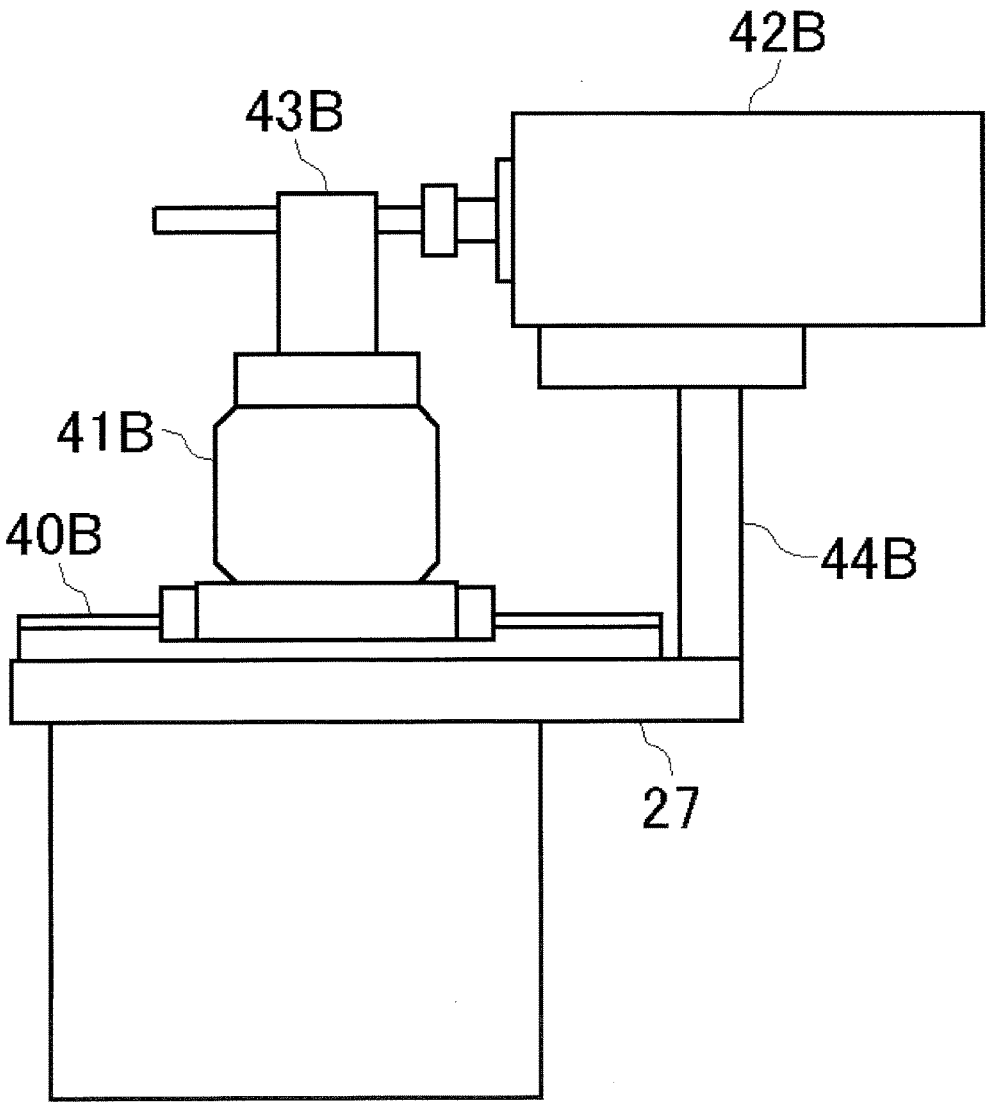
FIG. 8 is a cross-sectional view taken along line H-H in FIG. 7.
Figure 9:
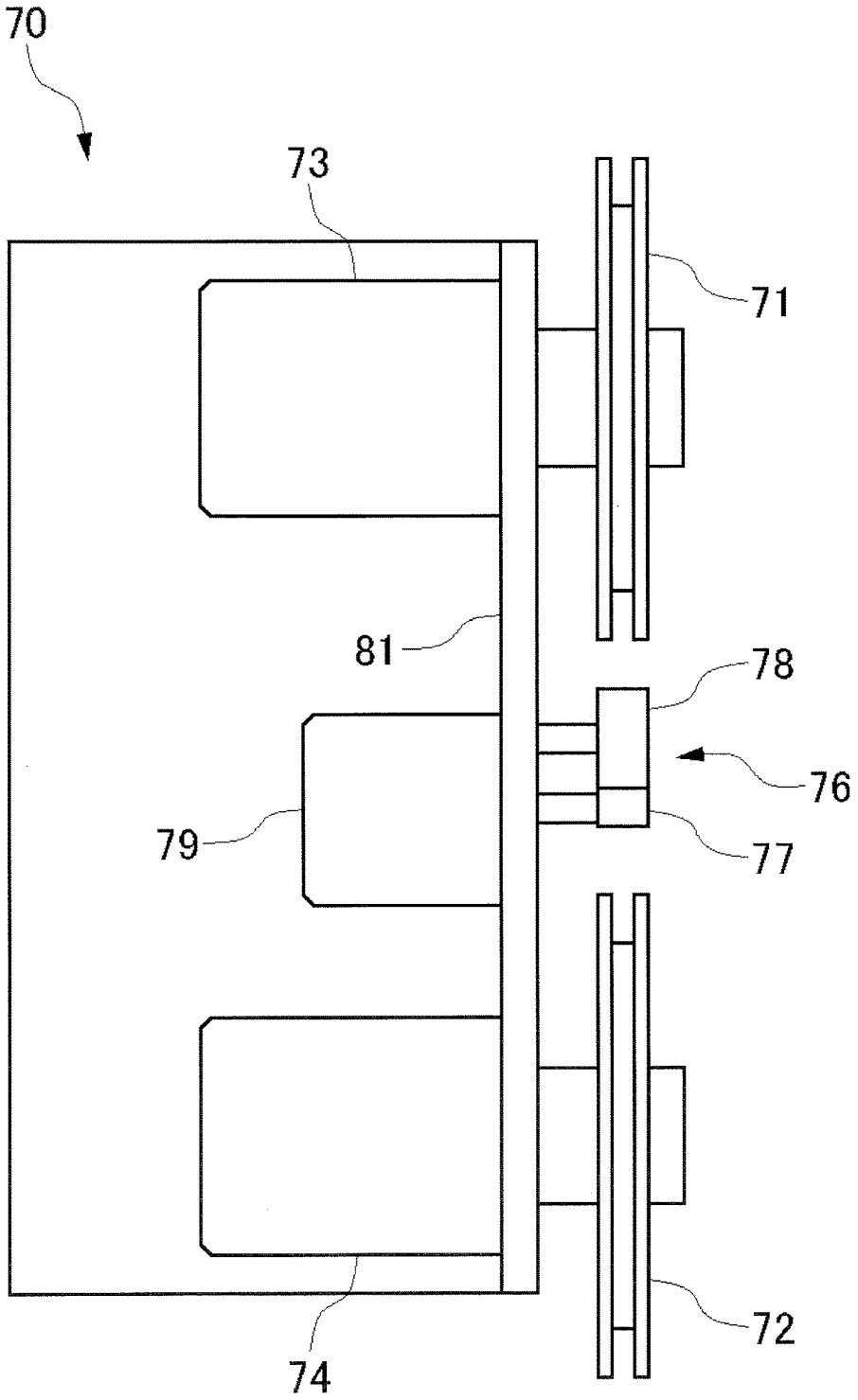
FIG. 9 is a side view of the polishing-tape supply and recovery mechanism illustrated in FIG. 7.
Figure 10:
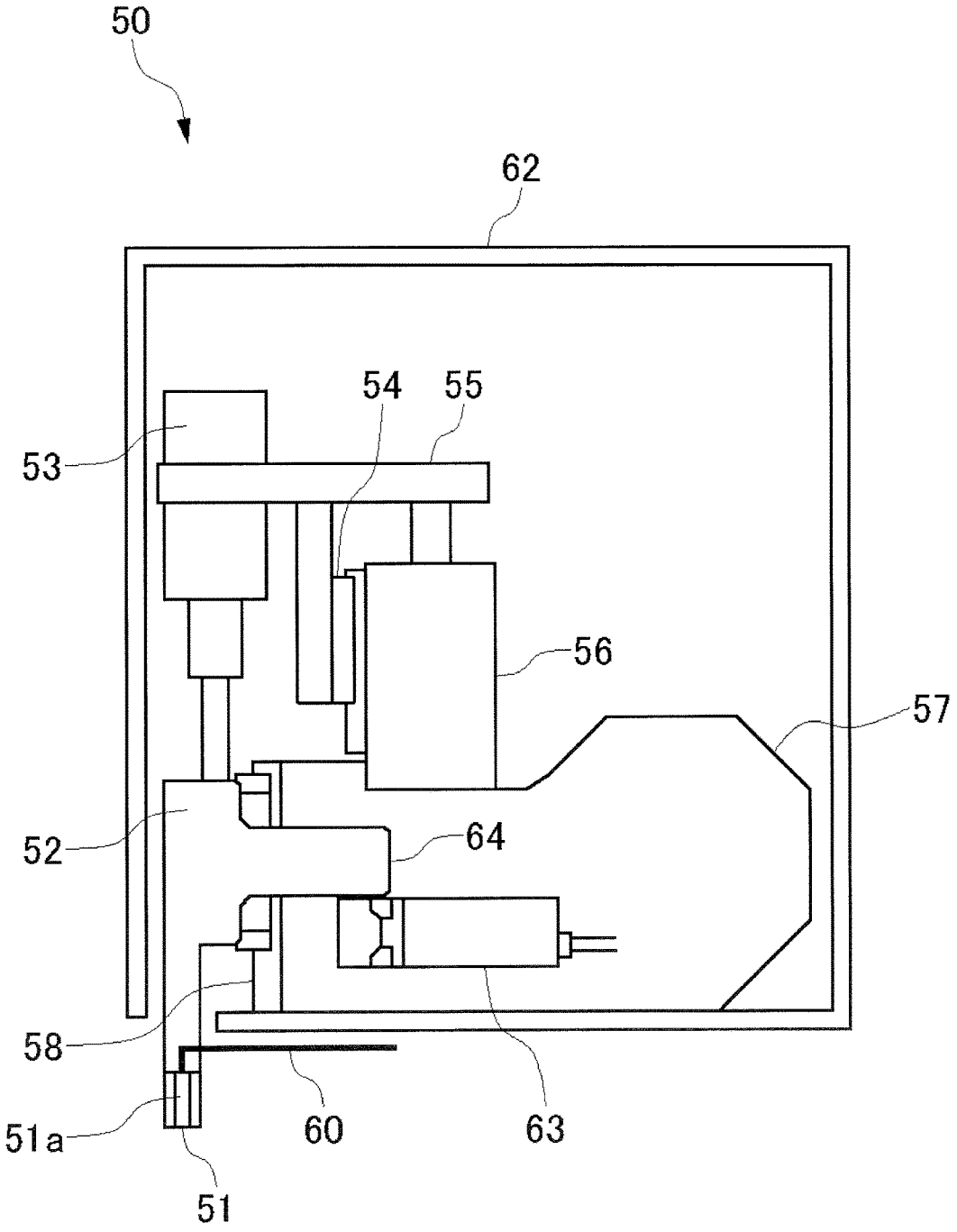
FIG. 10 is a vertical cross-sectional view of the polishing head as viewed from a direction indicated by arrow I in FIG. 7.

FIG. 6 is a plan view of the polishing head 50 and the polishing-tape supply and recovery mechanism 70, FIG. 7 is a front view of the polishing head 50 and the polishing-tape supply and recovery mechanism 70, FIG. 8 is a cross-sectional view taken along line H-H in FIG. 7, FIG. 9 is a side view of the polishing-tape supply and recovery mechanism 70 illustrated in FIG. 7, and FIG. 10 is a vertical cross-sectional view of the polishing head 50 as viewed from a direction indicated by arrow I in FIG. 7.

Two linear motion guides 40A and 40B, which extend in parallel to a radial direction of the substrate W, are disposed on the mount base 27. The polishing head 50 and the linear motion guide 40A are coupled to each other via a coupling block 41A. Further, the polishing head 50 is coupled to a motor 42A and a ball screw 43A for moving the polishing head 50 along the linear motion guide 40A (that is, in the radial direction of the substrate W). More specifically, the ball screw 43A is secured to the coupling block 41A, and the motor 42A is secured to the mount base 27 through a support member 44A. The motor 42A is configured to rotate a screw shaft of the ball screw 43A, so that the coupling block 41A and the polishing head 50 (which is coupled to the coupling block 41A) are moved along the linear motion guide 40A. The motor 42A, the ball screw 43A, and the linear motion guide 40A constitute a first moving mechanism for moving the polishing head 50 in the radial direction of the substrate W held on the substrate holder 3.

Similarly, the polishing-tape supply and recovery mechanism 70 and the linear motion guide 40B are coupled to each other via a coupling block 41B. Further, the polishing-tape supply and recovery mechanism 70 is coupled to a motor 42B and a ball screw 43B for moving the polishing-tape supply and recovery mechanism 70 along the linear motion guide 40B (that is, in the radial direction of the substrate W). More specifically, the ball screw 43B is secured to the coupling block 41B, and the motor 42B is secured to the mount base 27 through a support member 44B. The motor 42B is configured to rotate a screw shaft of the ball screw 43B, so that the coupling block 41B and the polishing-tape supply and recovery mechanism 70 (which is coupled to the coupling block 41B) are moved along the linear motion guide 40B. The motor 42B, the ball screw 43B, and the linear motion guide 40B constitute a second moving mechanism for moving the polishing-tape supply and recovery mechanism 70 in the radial direction of the substrate W held on the substrate holder 3.

As illustrated in FIG. 10, the polishing head 50 has a pressing member 51 for pressing the polishing tape 38 against the substrate W, a pressing-member holder 52 that holds the pressing member 51, and an air cylinder 53 as an actuator configured to push down the pressing-member holder 52 (and the pressing member 51). The air cylinder 53 is held by a holding member 55. Further, the holding member 55 is coupled to an air cylinder 56 serving as a lifter via a linear motion guide 54 extending in a vertical direction. As a gas (for example, air) is supplied to the air cylinder 56 from a non-illustrated gas supply source, the air cylinder 56 pushes up the holding member 55. As a result, the holding member 55, the air cylinder 53, the pressing-member holder 52, and the pressing member 51 are elevated along the linear motion guide 54.

The air cylinder 56 is secured to a mount member 57 that is fixed to the coupling block 41A. The mount member 57 and the pressing-member holder 52 are coupled to each other via a linear motion guide 58 extending in the vertical direction. When the pressing-member holder 52 is pushed down by the air cylinder 53, the pressing member 51 is moved downward along the linear motion guide 58 to thereby press the polishing tape 38 against the peripheral portion of the substrate W. The pressing member 51 is made of resin (for example, PEEK (polyetheretherketone)), metal (for example, stainless steel), or ceramic (for example, SiC (silicon carbide)).

The pressing member 51 has a plurality of through-holes 51*a* extending in the vertical direction. A vacuum line 60 is coupled to the through-holes 51*a*. This vacuum line 60 has a valve (not illustrated in the drawings) therein. By opening this valve, a vacuum is produced in the through-holes 51*a* of the pressing member 51. When the vacuum is produced in the through-holes 51*a* with the pressing member 51 in contact with an upper surface of the polishing tape 38, this upper surface of the polishing tape 38 is held on a lower surface of the pressing member 51. Only one through-hole 51*a* may be provided in the pressing member 51.

The pressing-member holder 52, the air cylinder 53, the holding member 55, the air cylinder 56, and the mount member 57 are housed in a box 62. A lower portion of the pressing-member holder 52 projects from a bottom of the box 62, and the pressing member 51 is attached to this lower portion of the pressing-member holder 52. A position sensor 63 for detecting a vertical position of the pressing member 51 is disposed in the box 62. This position sensor 63 is mounted to the mount member 57. A dog 64, which serves as a sensor target, is provided on the pressing-member holder 52. The position sensor 63 is configured to detect the vertical position of the pressing member 51 based on the vertical position of the dog 64.

Figure 11:
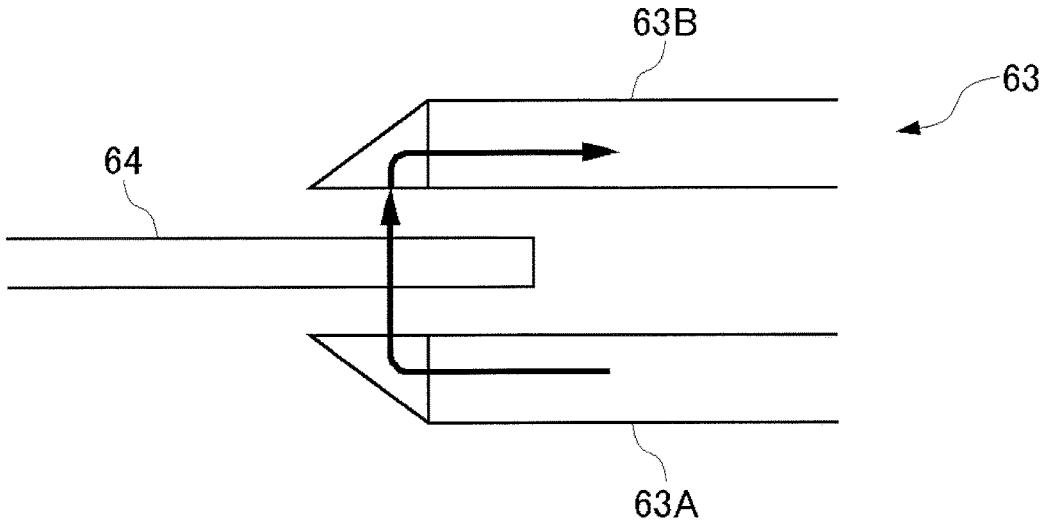
FIG. 11 is a top view of a position sensor and a dog according to an embodiment.
Figure 13:
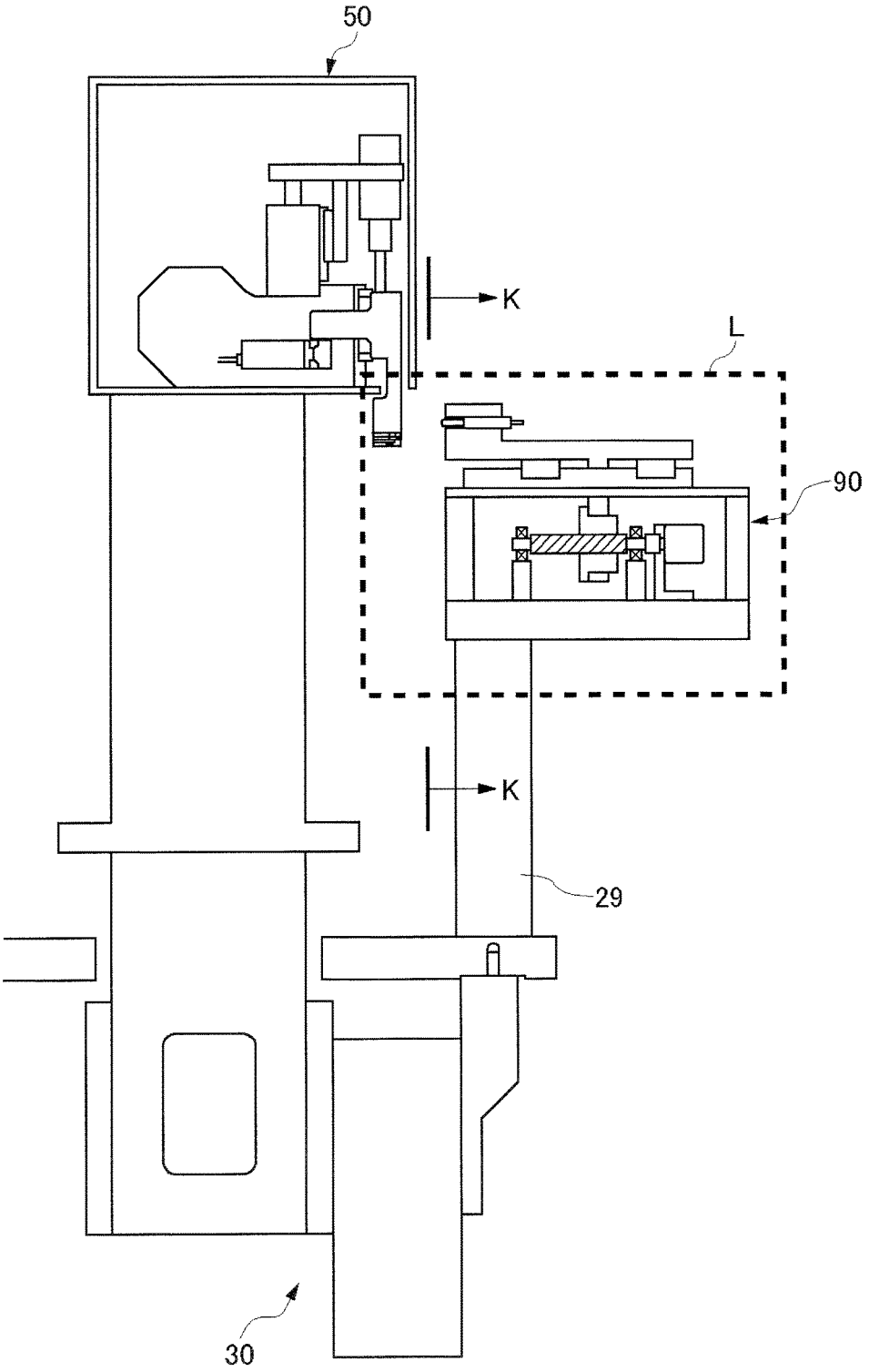
FIG. 13 is a cross-sectional view taken along line J-J in FIG. 12.

FIG. 11 is a view of the position sensor 63 and the dog 64 as viewed from above. The position sensor 63 has a light emitter 63A and a light receiver 63B. When the dog 64 is lowered together with the pressing-member holder 52 (and the pressing member 51), a part of light emitted from the light emitter 63A is interrupted by the dog 64. Therefore, the position of the dog 64, that is, the vertical position of the pressing member 51, can be detected from a quantity of the light received by the light receiver 63B. The position sensor 63 illustrated in FIG. 13 is a so-called transmission optical sensor. However, other types of position sensors may be used.

The polishing-tape supply and recovery mechanism 70 has a supply reel 71 for supplying the polishing tape 38 and a recovery reel 72 for recovering the polishing tape 38. The supply reel 71 and the recovery reel 72 are coupled to tension motors 73 and 74, respectively. These tension motors 73 and 74 are configured to apply predetermined torque to the supply reel 71 and the recovery reel 72 to thereby exert a predetermined tension on the polishing tape 38.

A polishing-tape sending mechanism 76 is provided between the supply reel 71 and the recovery reel 72. This polishing-tape sending mechanism 76 has a tape-sending roller 77 for sending the polishing tape 38, a nip roller 78 that presses the polishing tape 38 against the tape-sending roller 77, and a tape-sending motor 79 for rotating the tape-sending roller 77. The polishing tape 38 is interposed between the tape-sending roller 77 and the nip roller 78. By rotating the tape-sending roller 77 in a direction indicated by arrow in FIG. 7, the polishing tape 38 is sent from the supply reel 71 to the recovery reel 72.

The tension motors 73 and 74 and the tape-sending motor 79 are mounted on a pedestal 81. This pedestal 81 is secured to the coupling block 41B. The pedestal 81 has two support arms 82 and 83 extending from the supply reel 71 and the recovery reel 72 toward the polishing head 50. A plurality of guide rollers 84A, 84B, 84C, 84D, and 84E for supporting the polishing tape 38 are provided on the support arms 82 and 83. The polishing tape 38 is guided by these guide rollers 84A to 84E so as to surround the polishing head 50.

The extending direction of the polishing tape 38 is perpendicular to the radial direction of the substrate W as viewed from above. The two guide rollers 84D and 84E, which are located below the polishing head 50, support the polishing tape 38 such that the polishing surface of the polishing tape 38 is in parallel to the surface (upper surface) of the substrate W. Further, the polishing tape 38 extending between these guide rollers 84D and 84E is in parallel to the tangential direction of the substrate W. There is a clearance in the vertical direction between the polishing tape 38 and the substrate W.

Figure 12:
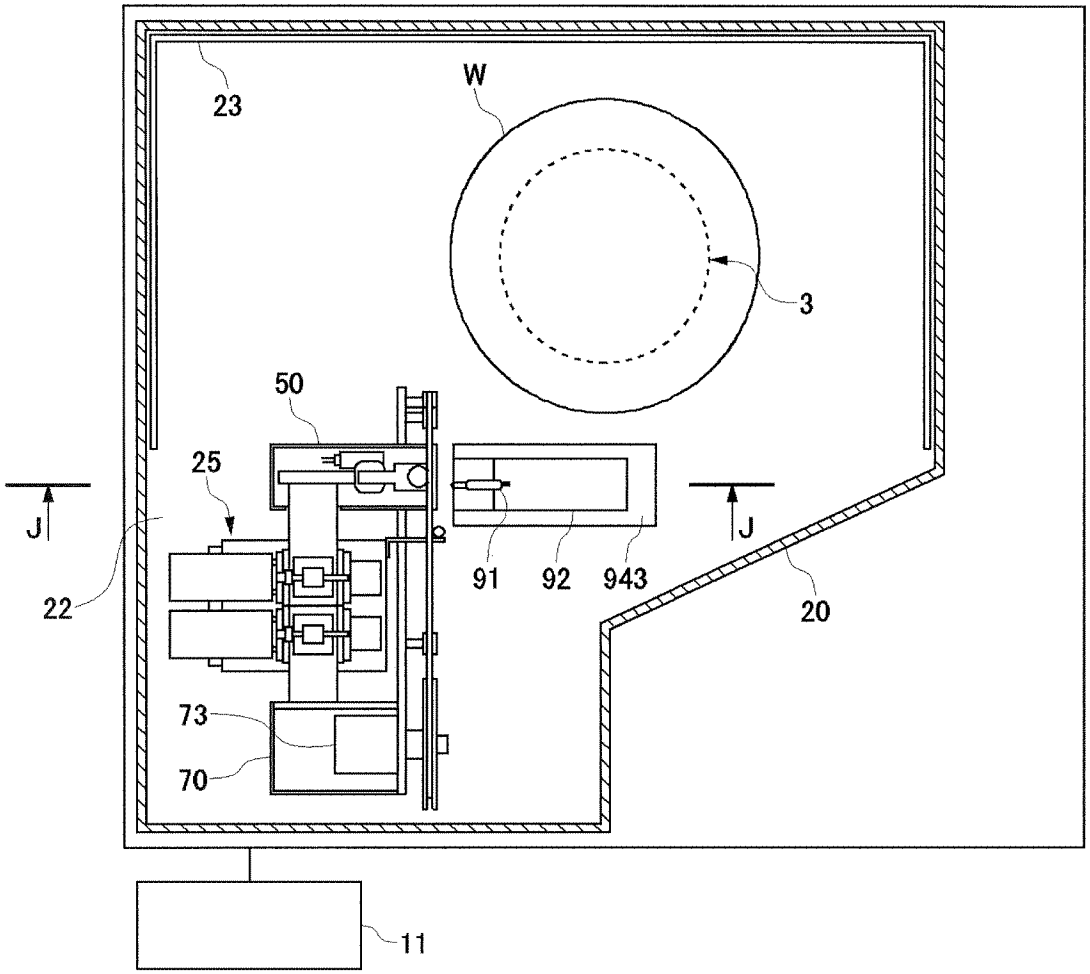
FIG. 12 is a plan view of a polishing apparatus when a polishing unit according to an embodiment is located at a tape alignment position.

In the polishing apparatus, a positioning unit 90 is provided in parallel to the substrate holder 3. FIG. 12 is a plan view of the polishing apparatus when the polishing unit 25 is at a tape alignment position, FIG. 13 is a cross-sectional view taken along line J-J in FIG. 12, FIG. 14 is a cross-sectional view taken along line K-K in FIG. 13, and FIG. 15 is an enlarged view of an L portion in FIG. 14.

The positioning unit 90 is supported on a support column 29 provided in the polishing chamber 22. The positioning unit 90 includes a position sensor 91, a positioning block 92 that holds the position sensor 91, a ball screw mechanism 93 that drives the positioning block 92 in a front-rear direction (the radial direction of the substrate W), and a motor M2 that rotates a shaft 931 of the ball screw mechanism 93. The ball screw mechanism 93 and the motor M2 are provided on a pedestal 941 fixed to the support column 29. Side plates 942 stand on the pedestal 941 so as to surround the ball screw mechanism 93 and the motor M2. The side plates 942 are covered by a top plate 943.

The positioning block 92 and the position sensor 91 held thereon are provided on the top plate 943. A plurality of rail blocks 95 is fixed to a lower surface of the positioning block 92, and a rail 96 that guides the rail block 95 in the front-rear direction is fixed to an upper surface of the top plate 943. The positioning block 92 has a coupling portion 921 which is provided on a lower surface of the positioning block 92 so as to pass through the top plate 943 and be fixed to a nut 932 of the ball screw mechanism 93. The positioning block 92 has a contacting surface 922 which is provided on a front side (the side close to the polishing unit 25) so as to conduct alignment between the pressing member 51 and the polishing tape 38. The contacting surface 922 is a flat surface formed in parallel in a vertical direction. The position sensor 91 is held on the positioning block 92 so that a distal end thereof protrudes slightly from the contacting surface 922. The position sensor 91 detects the amount of protrusion of the distal end and outputs the detected amount to an operation controller 11.

Figure 14:
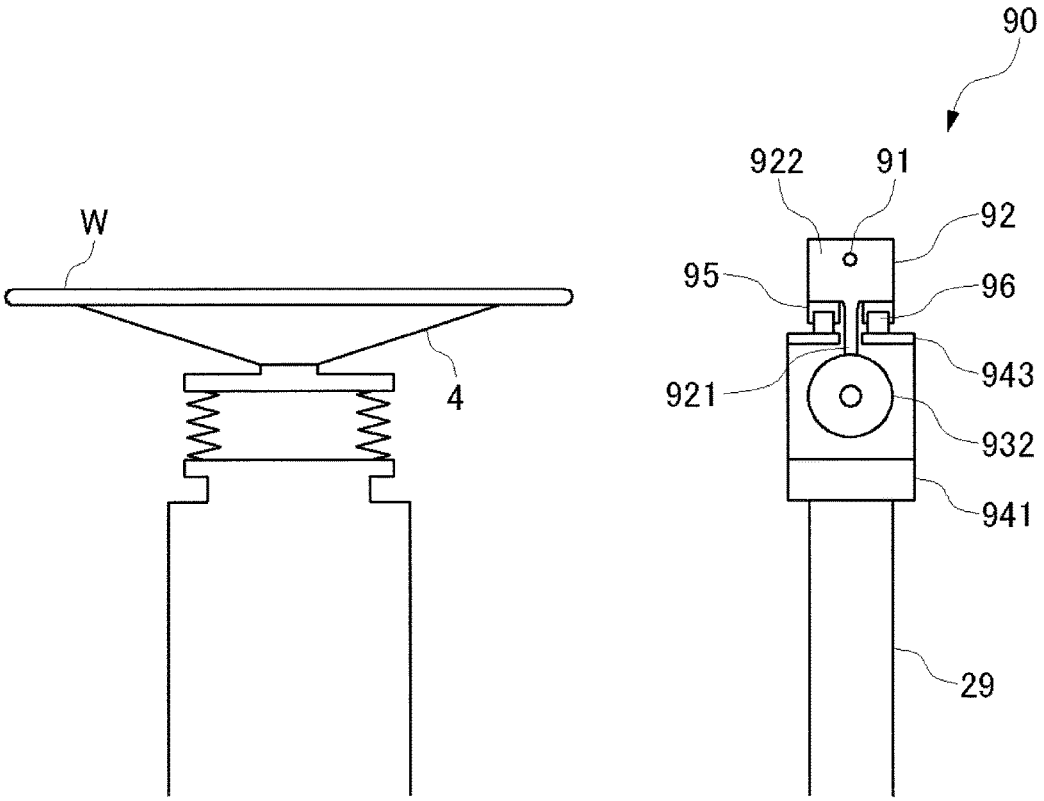
FIG. 14 is a cross-sectional view taken along line K-K in FIG. 13.
Figure 15:
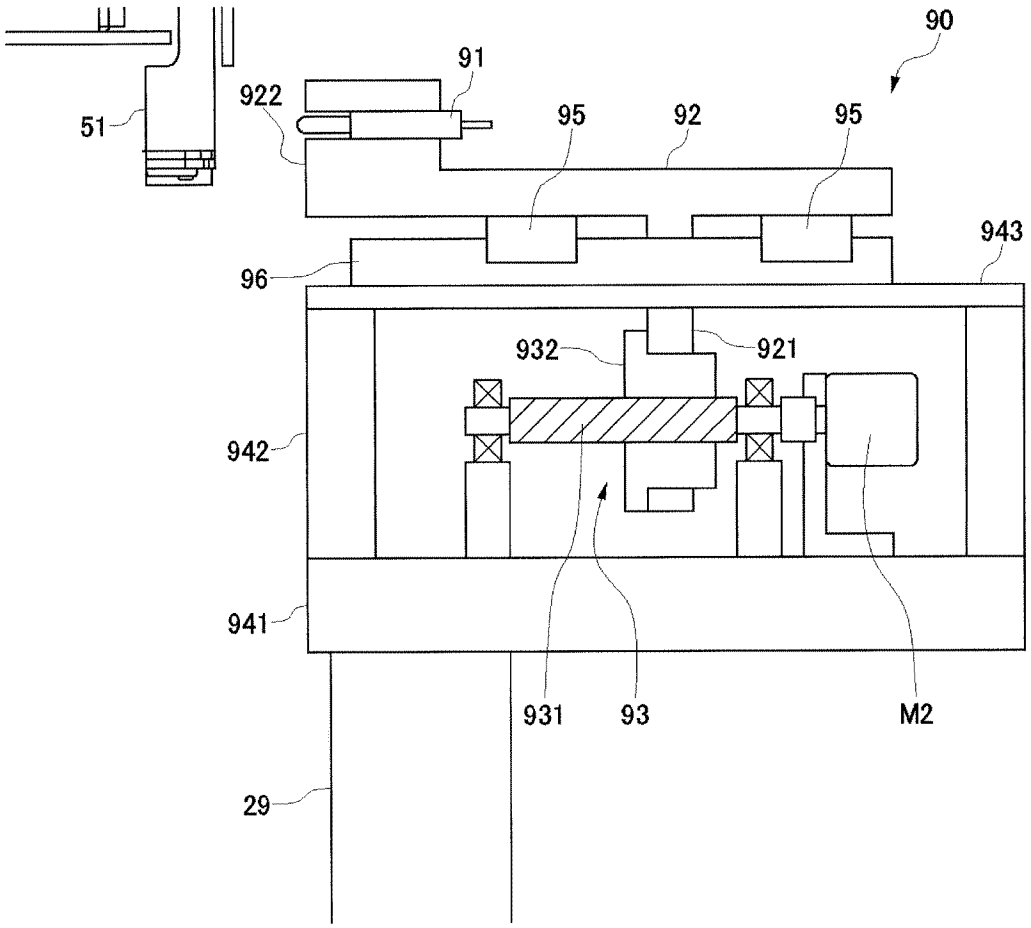
FIG. 15 is an enlarged view of an L portion in FIG. 14.

As illustrated in FIG. 14, the positioning block 92 is provided such that the height of the contacting surface 922 is higher than a polishing target surface (the upper surface) of the substrate W. This is to allow the polishing tape 38 to be positioned at a higher position than the polishing target surface of the substrate W so that the polishing tape 38 is adsorbed to the pressing member 51 at that position and is moved above the substrate W in that state and is pressed against the polishing target surface of the substrate W when the pressing member 51 moves down.

In the positioning unit 90 having such a configuration, when the motor M2 is driven, the shaft 931 of the ball screw mechanism 93 rotates and the nut 932 advances or retracts with the rotation. The positioning block 92 having the coupling portion 921 fixed to the nut 932 advances or retracts with the advancing or retracting of the nut 932. In this case, the positioning block 92 moves in the front-rear direction when the rail block 95 fixed to the lower surface of the positioning block 92 is guided by the rail 96.

Figure 16:
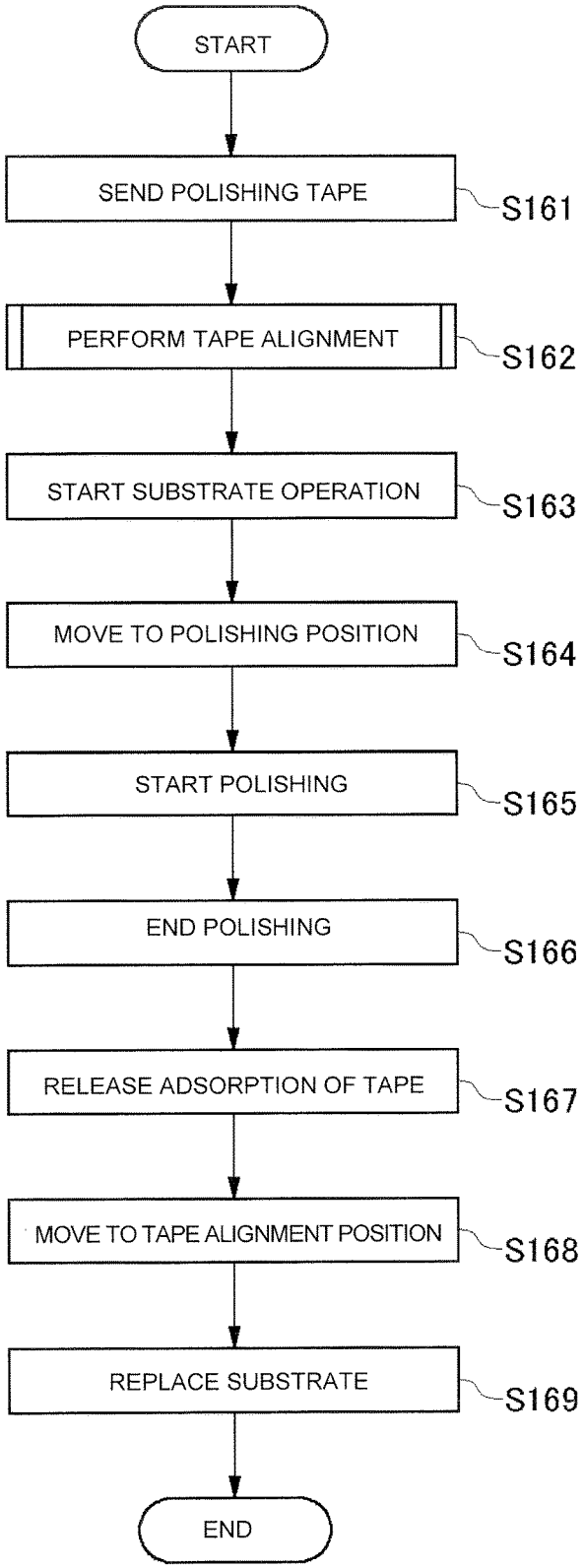
FIG. 16 is a flowchart illustrating an operation of a polishing apparatus according to an embodiment.

Next, polishing operations of the polishing apparatus having the above-described configuration will be described. The operations of the polishing apparatus described below are controlled by the operation controller 11 illustrated in FIG. 3. FIG. 16 is a flowchart illustrating the operation of the polishing apparatus. At the start of this operation flow, the substrate W is held by the substrate holder 3 such that a film (for example, a device layer) formed on the surface thereof faces upward, and the polishing unit 25 moves to the tape alignment position illustrated in FIG. 12. First, the tape-sending roller 77 is rotated in a direction indicated by an arrow in FIG. 7, whereby the polishing tape 38 is sent from the supply reel 71 to the recovery reel 72 and a new polishing surface is provided under the pressing member 51 (step S161). In this case, in a state in which the pressing member 51 is elevated by the air cylinder 56 (see FIG. 10), the pressing member 51 is positioned on the upper side of the polishing tape 38.

Subsequently, tape alignment is performed (step S162). Although the details of the tape alignment operation will be described later, with this tape alignment, the polishing tape 38 is adsorbed to the pressing member 51 by vacuum suction. When the tape alignment is completed and the polishing tape 38 is held on the pressing member 51, the substrate holder 3 holding the substrate W rotates about its center. Moreover, a substrate operation of supplying liquid (for example, pure water) from a liquid supply mechanism (not illustrated) to the center of the rotating substrate W starts (step S163).

Figure 17:
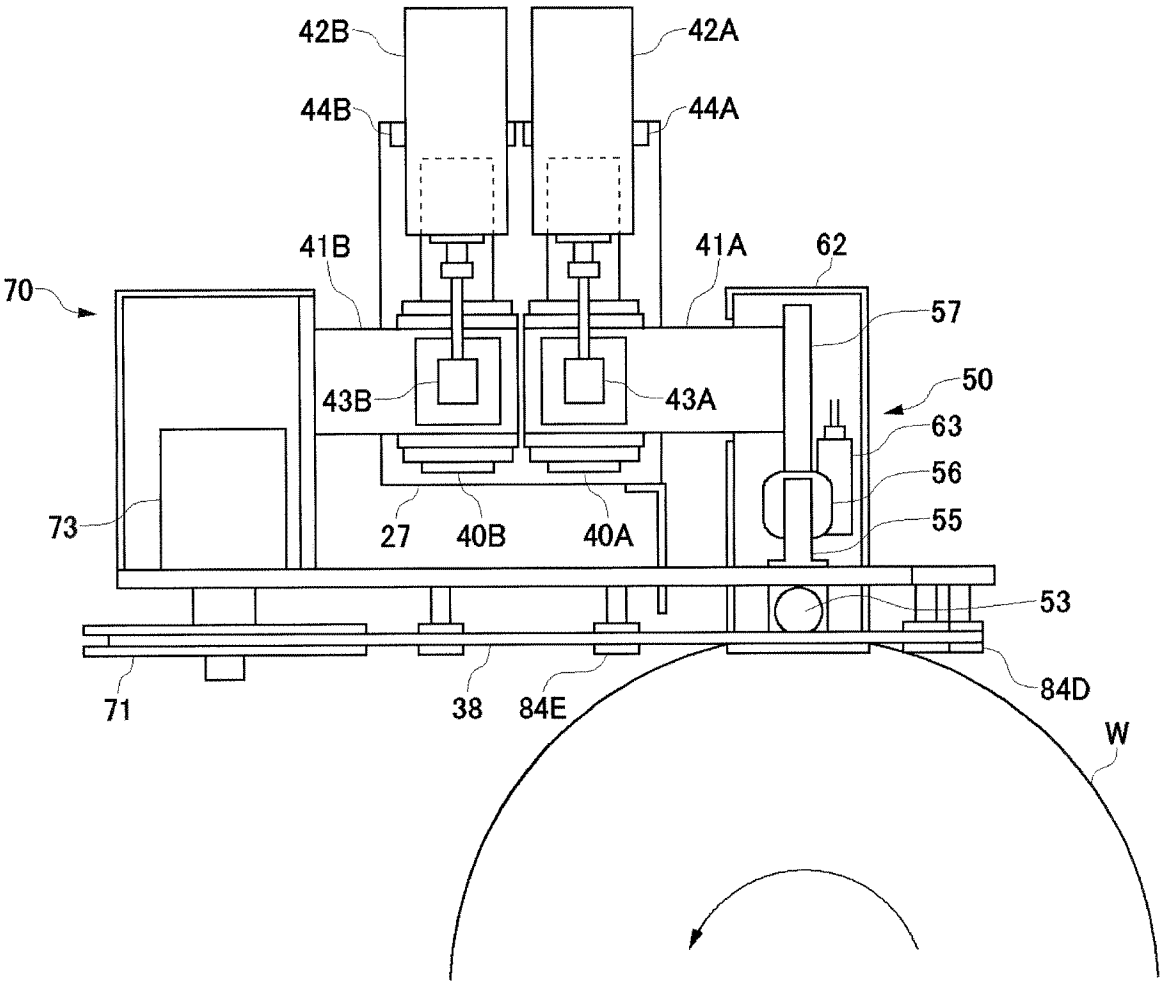
FIG. 17 is a plan view of a polishing unit located at a polishing position according to an embodiment.

The polishing-unit moving mechanism 30 moves the polishing unit 25 in which the pressing member 51 adsorbs the polishing tape 38 from the tape alignment position to the polishing position (step S164). FIG. 17 is a plan view of the polishing unit 25 being at the polishing position. At this polishing position, the pressing member 51 is lowered by the air cylinder 53 (see FIG. 10) while holding the polishing tape 38, and the pressing member 51 presses the polishing surface of the polishing tape 38 against the peripheral portion of the substrate W with predetermined polishing load to start polishing (step S165). The polishing load can be adjusted by the pressure of the gas supplied to the air cylinder 53.

The peripheral portion of the substrate W is polished by the sliding contact between the rotating substrate W and the polishing tape 38. In order to increase a polishing rate of the substrate W, the polishing tape 38 may be oscillated in the tangential direction of the substrate W by the polishing-unit moving mechanism 30 during polishing of the substrate W. During polishing, the liquid (for example, pure water) is supplied to the center of the rotating substrate W so that the substrate W is polished in the presence of the water. The liquid, supplied to the substrate W, spreads over the upper surface of the substrate W in its entirety via a centrifugal force. As a result, polishing waste is prevented from adhering to devices formed on the substrate W. As described above, since the polishing tape 38 is held on the pressing member 51 by vacuum suction during polishing, a positional misalignment between the polishing tape 38 and the pressing member 51 is prevented. As a result, a polishing position and a polishing profile can be stabilized. Further, even when the polishing load is increased, since a positional misalignment between the polishing tape 38 and the pressing member 51 does not occur, a polishing time can be shortened.

Figure 1A:
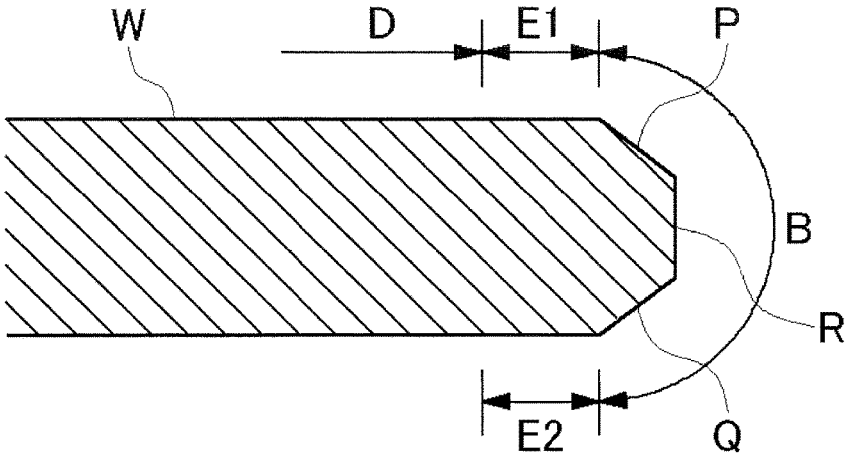
FIG. 1A is an enlarged cross-sectional view illustrating a peripheral portion of a straight-type substrate.
Figure 1B:
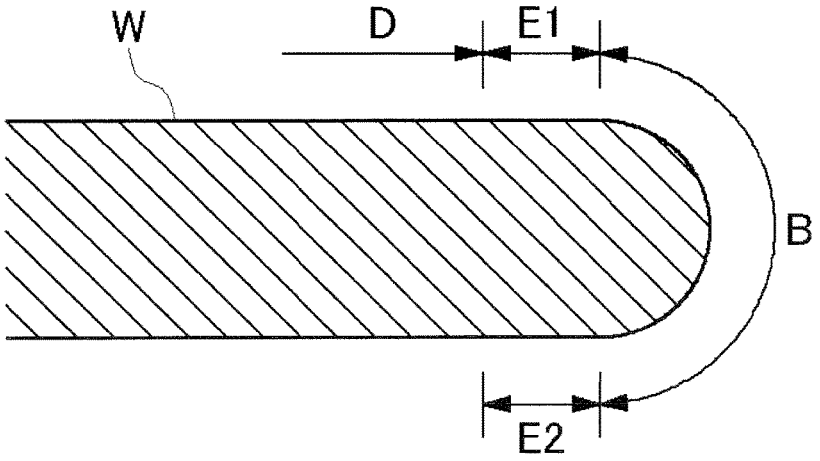
FIG. 1B is an enlarged cross-sectional view illustrating a peripheral portion of a round-type substrate.
Figure 2A:
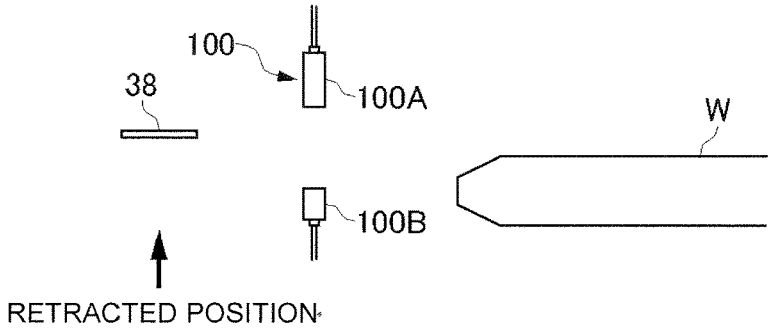
FIGS. 2A to 2C are diagrams illustrating an operation of detecting an edge of a polishing tape using a tape-edge detection sensor.
Figure 2B:
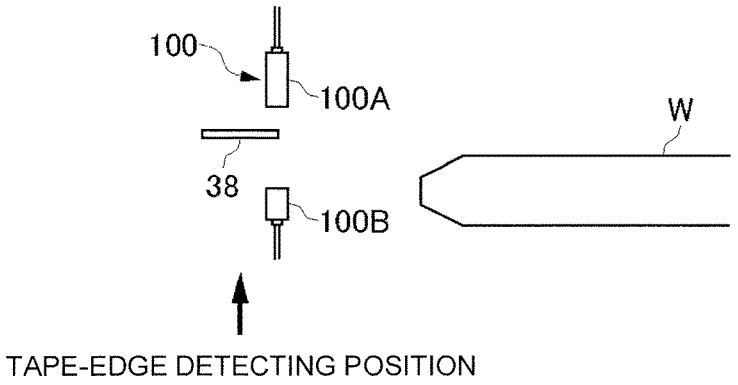
Figure 2C:
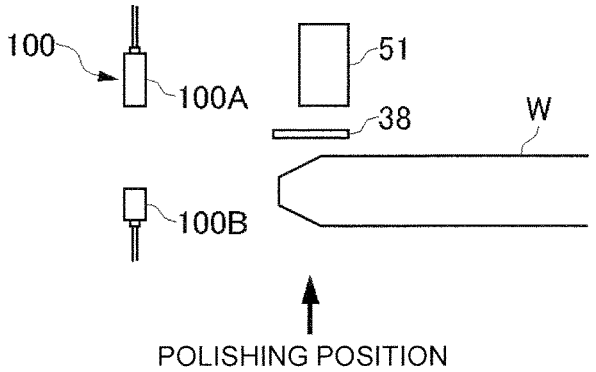
Figure 18:
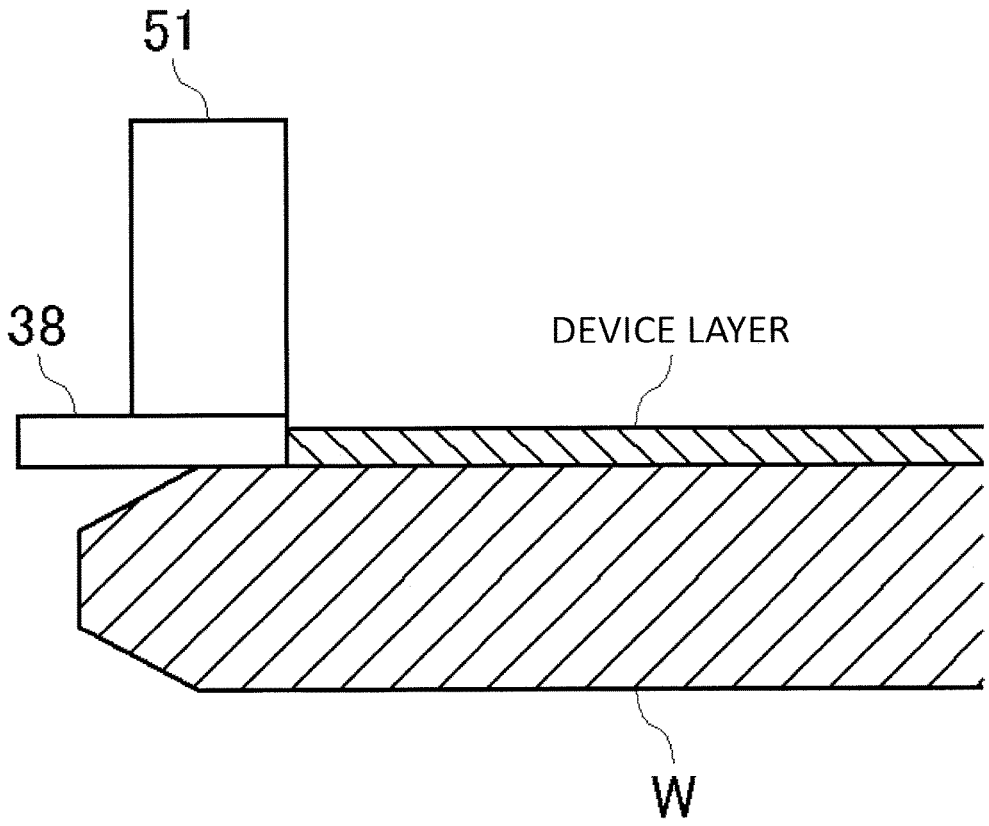
FIG. 18 is an enlarged view illustrating a peripheral portion of a substrate being polished by the polishing tape according to an embodiment.
Figure 19:
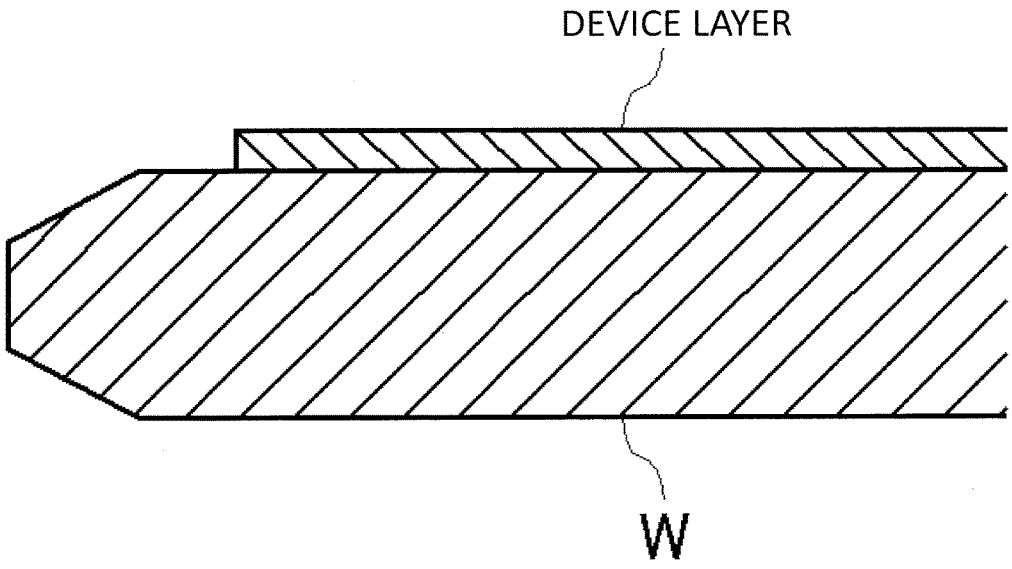
FIG. 19 is a view illustrating a cross-sectional shape of the substrate polished by the polishing apparatus according to an embodiment.

Because the polishing tape 38 is pressed from above by the pressing member 51, the polishing tape 38 can polish the top edge portion of the substrate W (see FIGS. 1A and 1B). FIG. 18 is an enlarged view illustrating the peripheral portion of the substrate W when being polished by the polishing tape 38. As illustrated in FIG. 18, a flat portion including the edge of the polishing tape 38 is pressed against the peripheral portion of the substrate W in a state in which the edge of the polishing tape 38 and the edge of the pressing member 51 coincide with each other. The edge of the polishing tape 38 is a right-angled corner. This right-angled edge of the polishing tape 38 is pressed against the peripheral portion of the substrate W from above by the edge of the pressing member 51. Therefore, as illustrated in FIG. 19, the polished substrate W can have a right-angled cross-sectional shape. That is, the device layer can have the edge surface perpendicular to the surface of the substrate W.

The position in the vertical direction of the pressing member 51 during polishing of the substrate W is detected by the position sensor 63. The operation controller 11 detects a polishing end point from the position in the vertical direction of the pressing member 51 based on the detection result of the position sensor 63 (step S166). For example, the operation controller 11 can terminate the polishing of the peripheral portion of the substrate W when the vertical position of the pressing member 51 reaches a predetermined target position. This predetermined target position is determined according to a target amount of polishing.

When polishing of the substrate W ends, the supply of gas to the air cylinder 53 is stopped, whereby the pressing member 51 is elevated and the vacuum suction of the polishing tape 38 is stopped. Further, the pressing member 51 only is elevated by the air cylinder 56 and the pressing member 51 and the polishing tape 38 are separated (step S167). Moreover, the polishing unit 25 is moved to the tape alignment position illustrated in FIG. 12 (step S168). The polished substrate W is elevated by the substrate holder 3 and is unloaded out of the polishing chamber 22 by the hands of a transporting mechanism (not illustrated), and a new substrate W is supplied to the substrate holder 3 (step S169).

Figure 20:
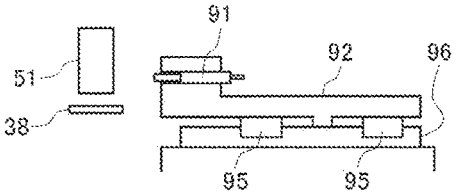
FIGS. 20 A1, 20 B1, 20 C1, 20 D1, and 20 E1 are side views illustrating a positional relation among a positioning block, a pressing member, and a polishing tape.
Figure 20:
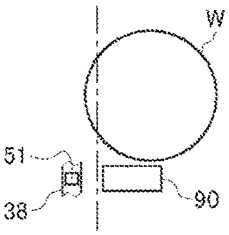
Figure 20:
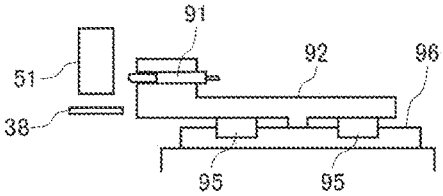
Figure 20:
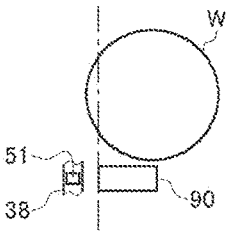
Figure 20:
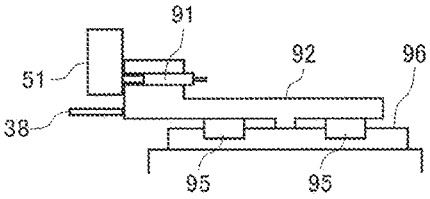
Figure 20:
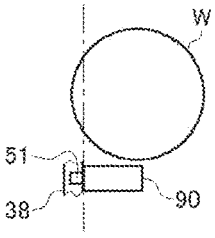
Figure 20:
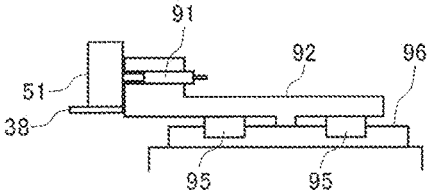
Figure 20:
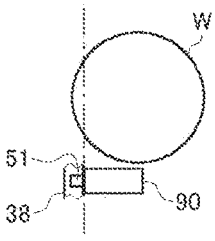
Figure 20:
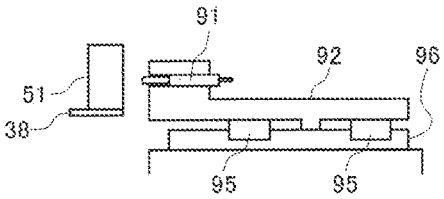
Figure 20:
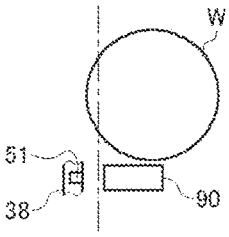
Figure 21:
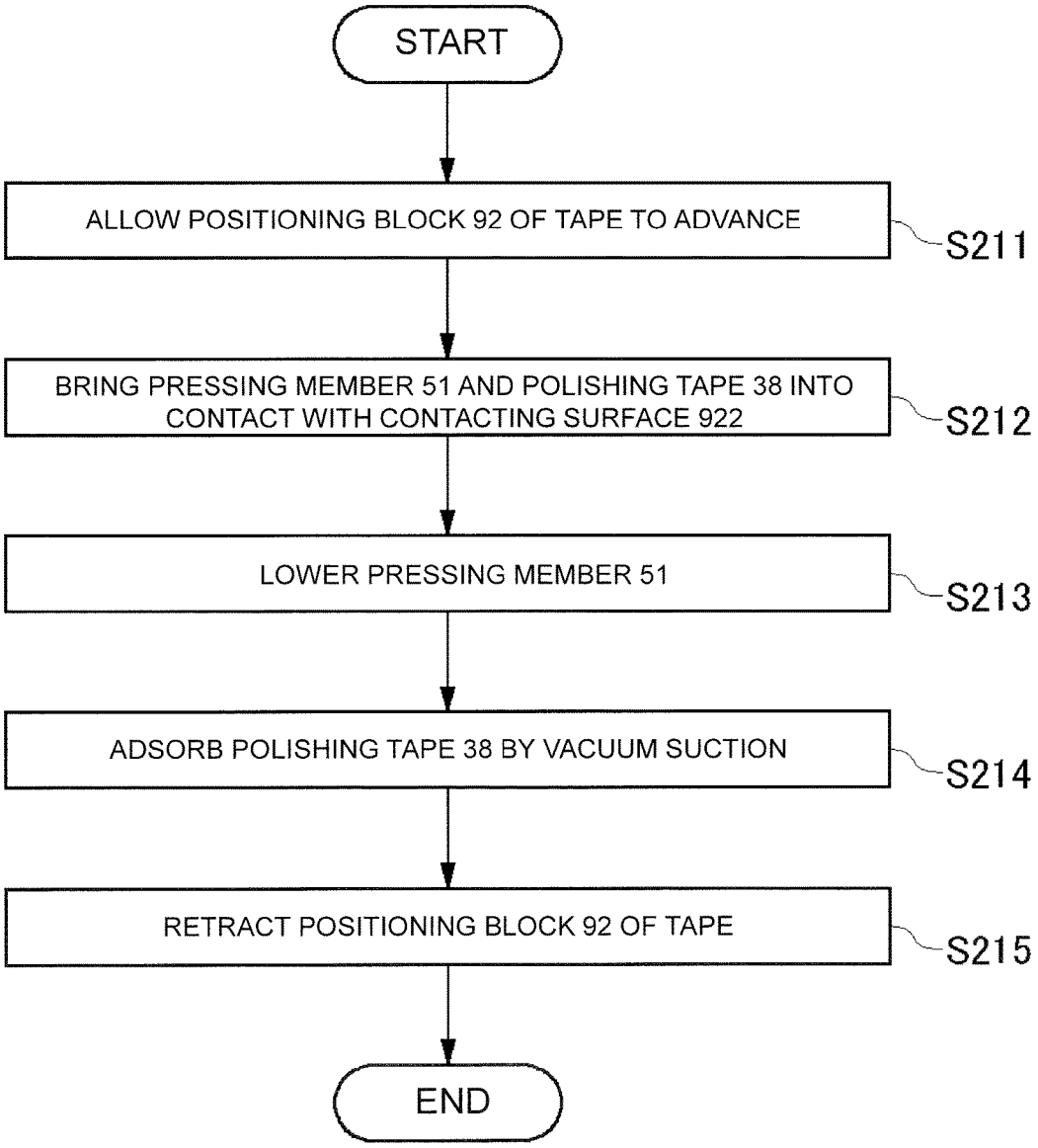
FIG. 21 is a flowchart illustrating a tape alignment operation of the polishing apparatus according to an embodiment.

Next, the tape alignment operation of step S162 will be described. The tape alignment operation is also controlled by the operation controller 11 illustrated in FIG. 3. FIGS. 20 A1, 20 B1, 20 C1, 20 D1, and 20 E1 are side views illustrating a positional relation among the positioning block 92, the pressing member 51, and the polishing tape 38, FIGS. 20 A2, 20 B2, 20 C2, 20 D2, and 20 E2 are plan views illustrating a positional relation among the substrate W, the positioning block 92, the pressing member 51, and the polishing tape 38, and FIG. 21 is a flowchart of the tape alignment operation. FIGS. 20 and 21 illustrate a case in which the pressing member 51 and the polishing tape 38 are aligned so that a substrate-side edge of the pressing member 51 perfectly coincides with a substrate-side edge of the polishing tape 38. As illustrated in FIG. 12, the tape alignment is performed when the polishing unit 25 is at the tape alignment position.

As illustrated in FIGS. 20 A1 and 20 A2, at first, the positioning block 92 is at the retracted position, and the pressing member 51 and the polishing tape 38 are not in alignment but are in an optional positional relation. Subsequently, as illustrated in FIGS. 20 B1 and 20 B2, the positioning block 92 advances toward the polishing head 50 (step S211). In this case, as illustrated in FIG. 20 B2, the positioning block 92 advances up to a position at which the contacting surface 922 coincides with an inner edge (an outer edge of the device layer) the edge portion of the substrate W. Subsequently, as illustrated in FIGS. 20 C1 and 20 C2, the pressing member 51 and the polishing tape 38 are moved toward the positioning block 92 so that both make contact with the contacting surface 922 of the positioning block 92 (step S212). When both the pressing member 51 and the polishing tape 38 make contact with the contacting surface 922, the substrate-side edges of the pressing member 51 and the polishing tape 38 are aligned and these edges coincide with the inner edge of the edge portion of the substrate W.

The contact of the pressing member 51 with the contacting surface 922 of the positioning block 92 may be determined based on the stopping of the movement of the pressing member 51 and may be determined by the position sensor 91 detecting the position of the pressing member 51. In the latter case, when the pressing member 51 pushes the distal end of the position sensor 91 toward the contacting surface 922, the position sensor 91 detects the amount of protrusion and sends the detection value to the operation controller 11. When an initial amount of protrusion of the position sensor 91 from the contacting surface 922 is L, the operation controller 11 controls the pressing member 51 to approach the contacting surface 922 until the amount of protrusion of the distal end of the position sensor 91 by the pressing member 51 reaches L and then stops the pressing member 51.

In a state in which the substrate-side edges of the pressing member 51 and the polishing tape 38 are aligned in this manner, the pressing member 51 is lowered as illustrated in FIG. 20 D1 (step S213) to make contact with the polishing tape 38, and in this state, the polishing tape 38 is adsorbed to the pressing member 51 by vacuum suction (step S214). When the vacuum suction is completed and the polishing tape 38 is held on the pressing member 51 in a state in which the substrate-side edges of the pressing member 51 and the polishing tape 38 are aligned, the positioning block 92 retracts and returns to the initial retracted position as illustrated in FIGS. 20 E1 and 20 E2 (step S215).

As described above, according to the positioning unit 90 of this embodiment, the pressing member 51 and the polishing tape 38 are positioned by making contact with the contacting surface 922 of the positioning block 92, and the edges on the inner side of the substrate W during polishing can be aligned. That is, since the positions of the pressing member 51 and the polishing tape 38 can be physically aligned without detecting the positions using an optical sensor, the accuracy of the alignment between the pressing member 51 and the polishing tape 38 may not decrease due to scattering of light by water droplets. Moreover, it is not necessary to prepare an air nozzle for removing water droplets which are the cause of a decrease in the accuracy.

Moreover, in the positioning of the pressing member 51 and the polishing tape 38, the positioning in the radial direction of the substrate W and the pressing member 51 that adsorbs and holds the polishing tape 38 is also conducted. Thus, when the positioning is completed, the polishing unit 25 is moved in parallel up to the polishing position at which the pressing member 51 is positioned above the edge portion of the substrate W.

In the above example, although alignment is performed so that the substrate-side edges of the pressing member 51 and the polishing tape 38 coincide with each other, the positioning unit 90 may conduct alignment in such a positional relation that the edge of the polishing tape 38 is located slightly closer to the substrate side than the edge of the pressing member 51. Hereinafter, the edge of the polishing tape 38 protruding closer to the substrate side than the edge of the pressing member 51 will be referred to as a tape allowance.

Figure 22:
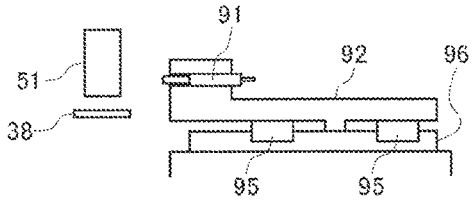
FIGS. 22 A1, 22 B1, 22 C1, 22 D1, and 22 E1 are side views illustrating a positional relation among a positioning block, a pressing member, and a polishing tape when alignment which provides a tape allowance is performed.
Figure 22:
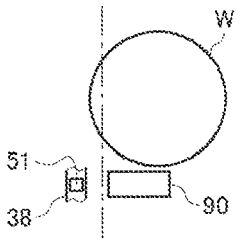
Figure 22:
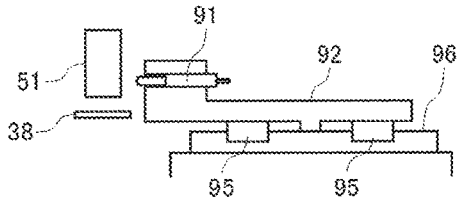
Figure 22:
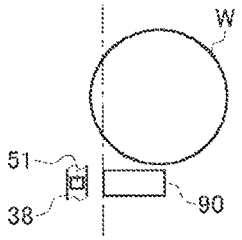
Figure 22:
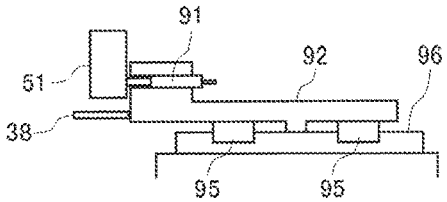
Figure 22:
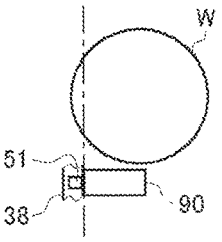
Figure 22:
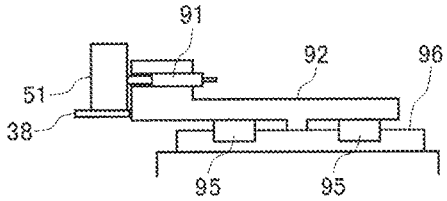
Figure 22:
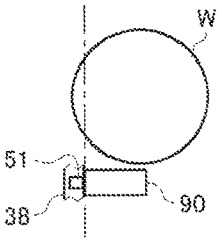
Figure 22:
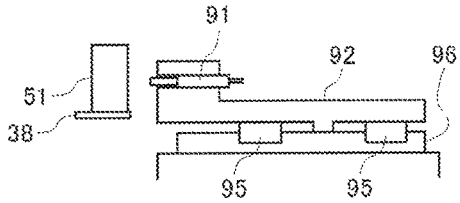
Figure 22:
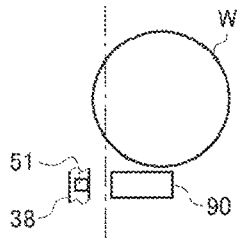

FIGS. 22 A1, 22 B1, 22 C1, 22 D1, and 22 E1 are side views illustrating a positional relation among the positioning block 92, the pressing member 51, and the polishing tape 38 when alignment which provides a tape allowance is performed, and FIGS. 22 A2, 22 B2, 22 C2, 22 D2, and 22 E2 are plan views illustrating a positional relation among the substrate W, the positioning block 92, the pressing member 51, and the polishing tape 38. As illustrated in FIGS. 22 A1 and 22 A2, when the pressing member 51 and the polishing tape 38 are in an optional positional relation, the operations in such a course that the positioning block 92 advances toward the polishing head 50 as illustrated in FIGS. 22 B1 and 22 B2 are the same as those of the example of FIG. 20. Subsequently, as illustrated in FIGS. 22 C1 and 22 C2, the pressing member 51 and the polishing tape 38 are moved toward the contacting surface 922 of the positioning block 92.

Here, in this example, although the polishing tape 38 is moved until making contact with the contacting surface 922, the pressing member 51 is moved until the position sensor 91 reaches a position at which a gap corresponding to the tape allowance is formed between the substrate-side edge of the pressing member 51 and the contacting surface 922. Specifically, when the pressing member 51 presses the distal end of the position sensor 91 toward the contacting surface 922, the position sensor 91 detects the amount of protrusion of the distal end and sends the detection value to the operation controller 11. When the initial amount of protrusion of the position sensor 91 from the contacting surface 922 is L and a target tape allowance of the polishing tape 38 is a, the operation controller 11 controls the pressing member 51 to approach the contacting surface 922 until the amount of protrusion of the distal end of the position sensor 91 by the pressing member 51 reaches L-a, and then, stops the pressing member 51. FIGS. 22 C1 and 22 C2 illustrate a state in which the pressing member 51 is moved by a desired amount in this manner until the polishing tape 38 makes contact with the contacting surface 922.

Subsequently, as illustrated in FIG. 22 D1, the pressing member 51 is lowered toward the polishing tape 38 and the pressing member 51 adsorbs the polishing tape 38 by vacuum suction while allowing the tape allowance to remain. When the polishing tape 38 is held on the pressing member 51, the positioning block 92 retracts as illustrated in FIGS. 22 E1 and 22 E2. As described above, in this example, the polishing tape 38 is mechanically aligned by making contacting with the contacting surface 922 of the positioning block 92. Moreover, the distance of the pressing member 51 from the contacting surface 922 is controlled by the amount of protrusion of the position sensor 91 from the contacting surface 922 serving as the reference of a mechanical alignment of the polishing tape 38. Thus, alignment between the pressing member 51 and the polishing tape 38 can be conducted while securing a desired tape allowance without using an optical sensor.

The tape allowance of the polishing tape 38 is a parameter that affects a polishing profile. If the tape allowance is set to 0, although the substrate-side edges of the pressing member 51 and the polishing tape 38 coincide with each other as illustrated in FIGS. 20 A1, 20 B1, 20 C1, 20 D1, and 20 E1) and the polished substrate W can have a right-angled cross-section as illustrated in FIG. 19, cracks or chips may occur due to vibration of the apparatus depending on the type of the substrate W. Thus, by setting the tape allowance appropriately in accordance with the type of the substrate W, it is possible to reduce the possibility of cracks or chips in the substrate W. Moreover, the polished substrate W may have an R-shaped cross-section if necessary.

Figure 23:
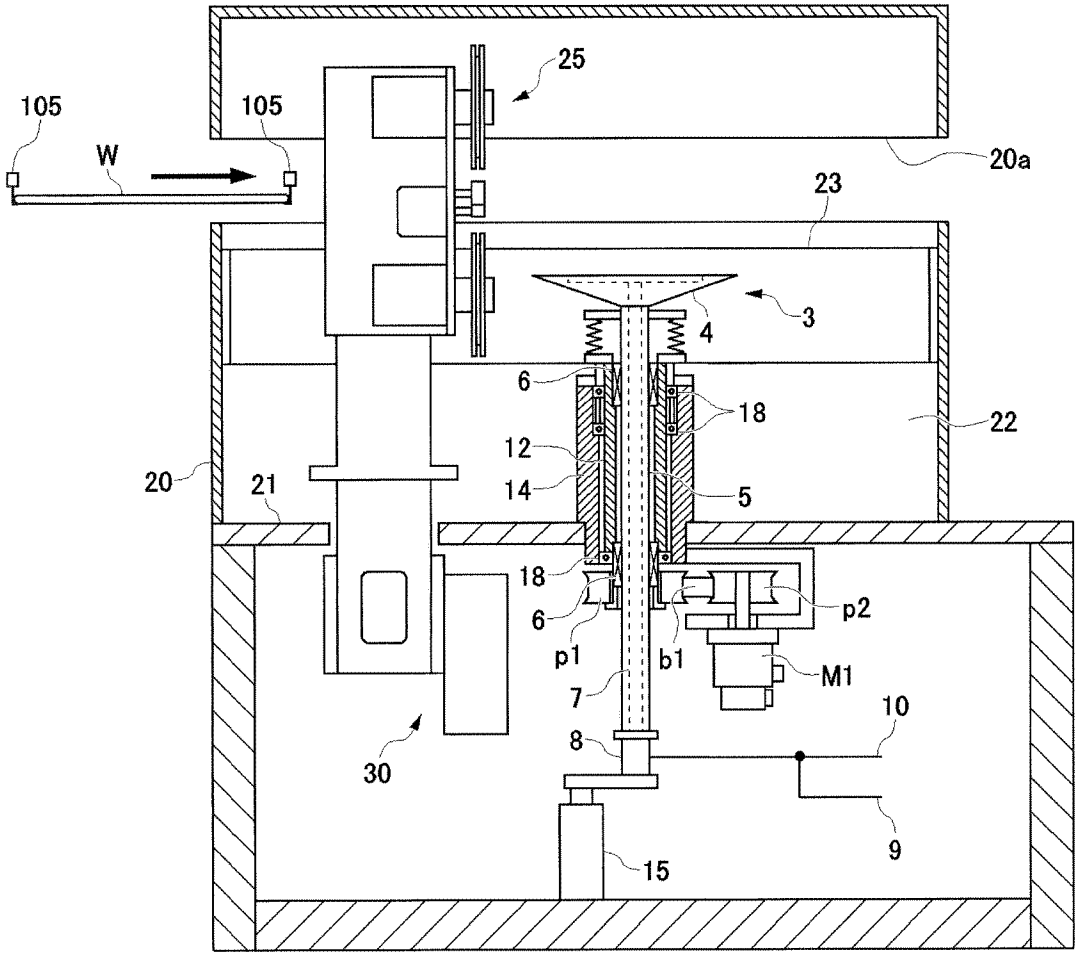
FIG. 23 is a diagram illustrating how a substrate is loaded into a polishing chamber through an entrance in the polishing apparatus according to an embodiment.
Figure 24:
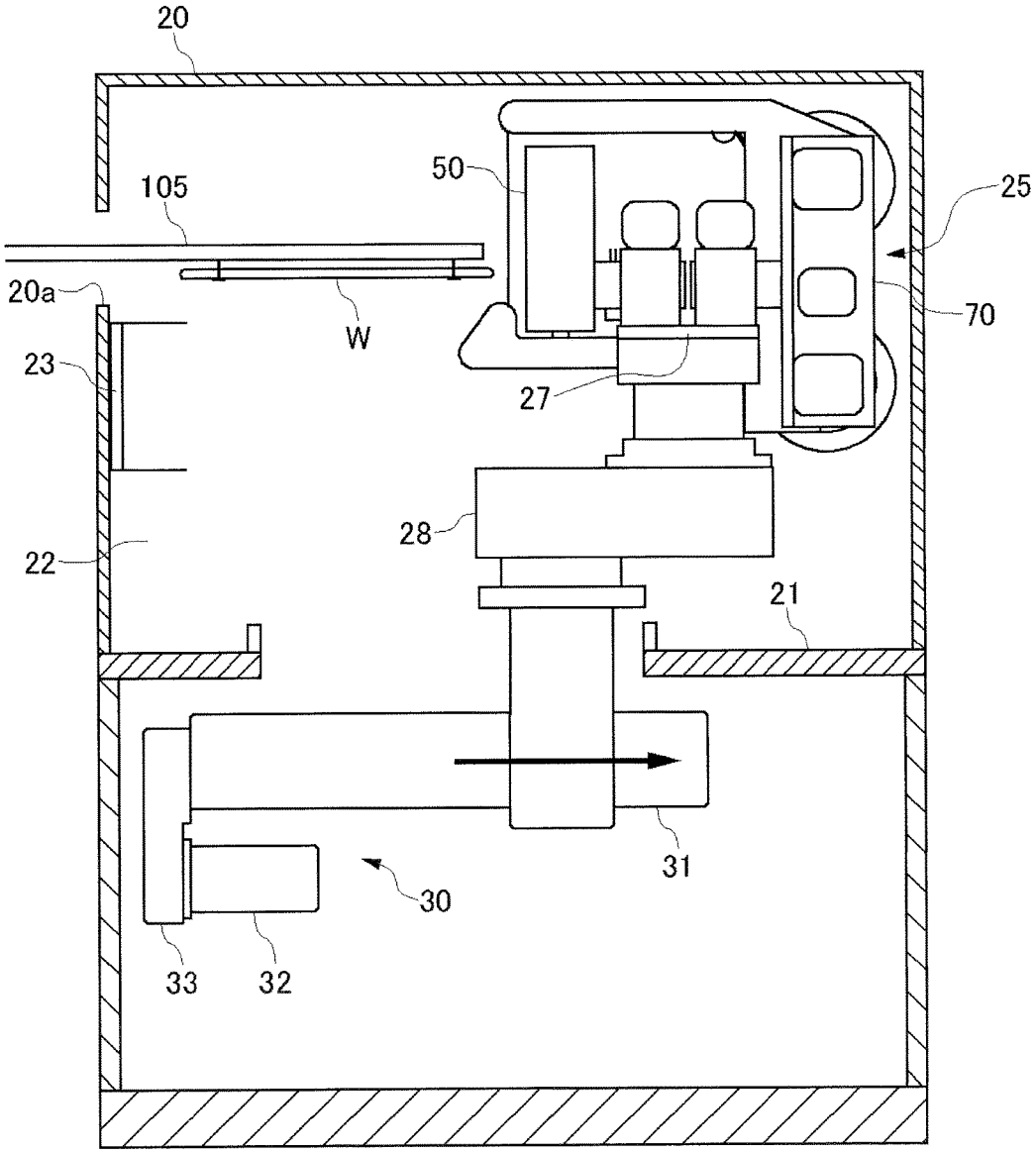
FIG. 24 is a diagram illustrating how a substrate is loaded into a polishing chamber through an entrance in the polishing apparatus according to an embodiment.

As illustrated in FIGS. 3 to 5, the partition 20 has an entrance 20*a* through which the substrate W is loaded into and unloaded out of the polishing chamber 22. The entrance 20*a* is in the form of a horizontally extending cutout. This entrance 20*a* can be closed by a shutter 23. As illustrated in FIG. 23, the substrate W to be polished is loaded into the polishing chamber 22 through the entrance 20*a* by hands 105 of a transporting mechanism, with the shutter 23 opened. As illustrated in FIG. 24, the polishing unit 25 is moved to the retracted position by the above-described polishing-unit moving mechanism 30 so that the substrate W does not bump into the polishing unit 25.

Figure 25:
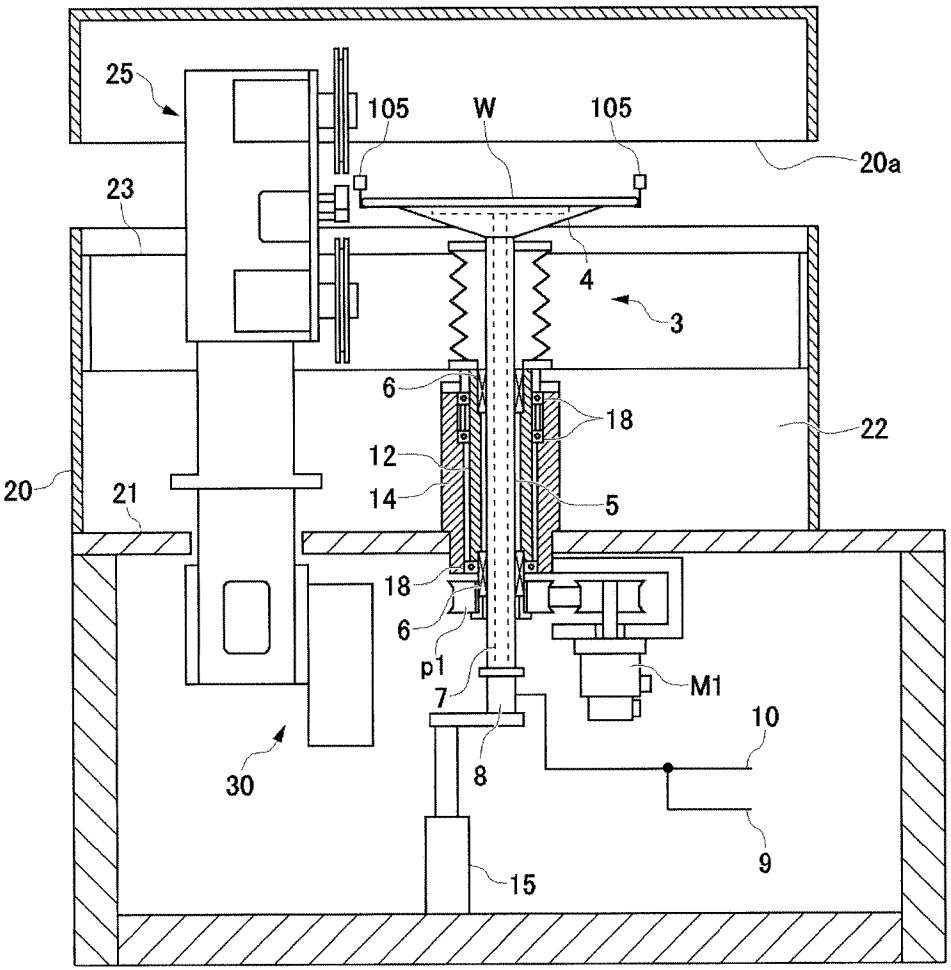
FIG. 25 is a view illustrating how a substrate is held on an upper surface of a holding stage in the polishing apparatus according to an embodiment.

After the substrate W is loaded into the polishing chamber 22, the air cylinder 15 is operated to elevate the holding stage 4 as illustrated in FIG. 25, so that the substrate W is held on the upper surface of the holding stage 4. Thereafter, the holding stage 4 is lowered, together with the substrate W, to the predetermined polishing position. FIG. 4 illustrates that the substrate W is in the polishing position. Then the polishing unit 25 is moved from the retracted position illustrated in FIG. 24 to the substrate polishing position illustrated in FIG. 5, and polishes the substrate W in a manner as described above. During polishing of the substrate W, the entrance 20*a* is closed by the shutter 23.

Figure 26:
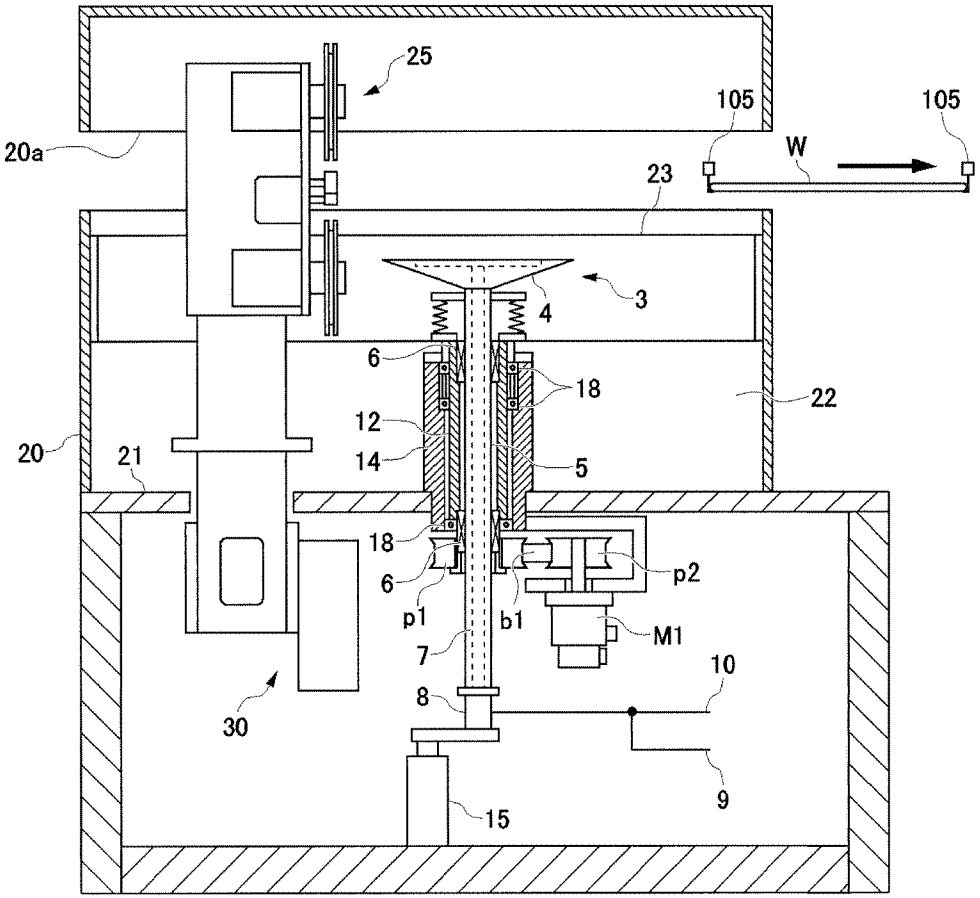
FIG. 26 is a view illustrating how a substrate is unloaded out of a polishing chamber in the polishing apparatus according to an embodiment.

After polishing of the substrate W is completed, the polishing unit 25 is moved to the retracted position illustrated in FIG. 24 again by the above-described polishing-unit moving mechanism 30. Thereafter, the hands 105 enter into the polishing chamber 22. Further, the holding stage 4, together with the substrate W, is elevated again to a substrate transport position illustrated in FIG. 25. The hands 105 grasp the substrate W and unloads the substrate W out of the polishing chamber 22 as illustrated in FIG. 26. In this manner, the substrate W, held by the hands 105, can travel across the polishing chamber 22 through the entrance 20*a* while keeping its horizontal position.

Figure 27:
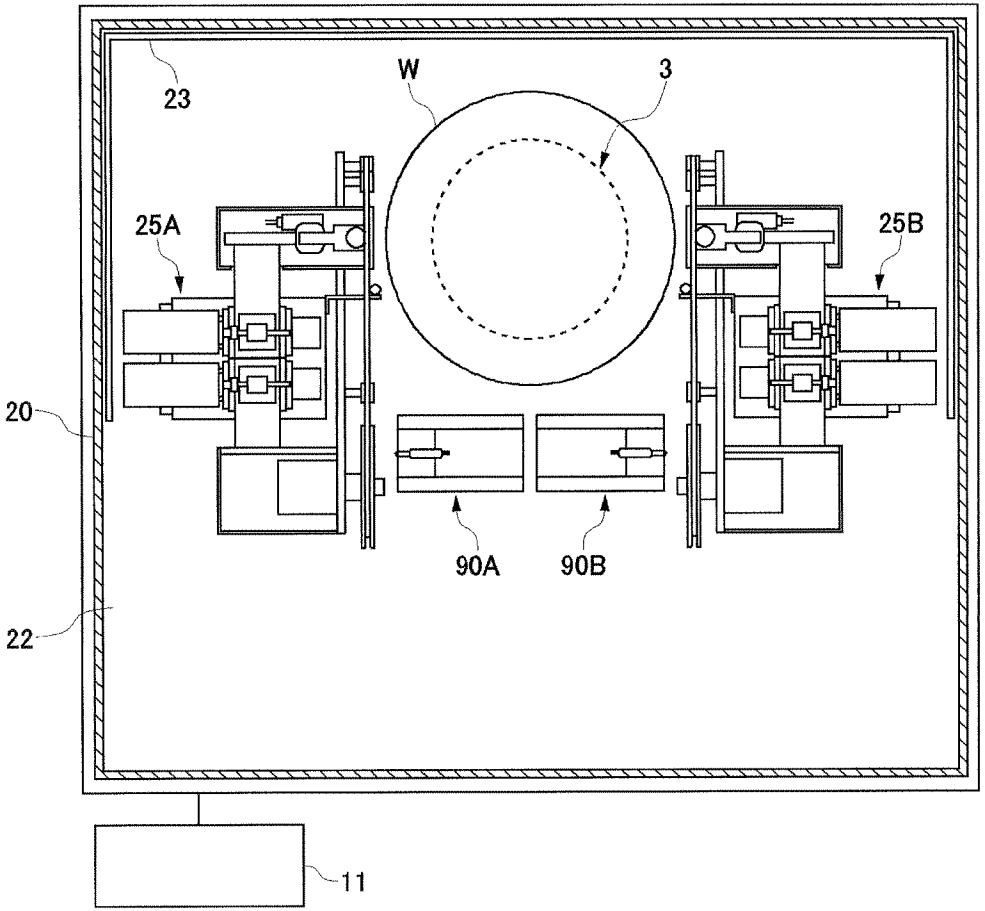
FIG. 27 is a plan view illustrating a polishing apparatus including a plurality of polishing units according to an embodiment.

FIG. 27 is a plan view illustrating the polishing apparatus having a plurality of polishing units with the above-discussed configuration. In this polishing apparatus, a first polishing unit 25A, a second polishing unit 25B, a first positioning unit 90A, a second positioning unit 90B are provided in the polishing chamber 22. These two polishing units 25A and 25B are symmetrical about the substrate W held by the substrate holder 3, and the two positioning units 90A and 90B are also symmetrical about the substrate W. The first polishing unit 25A is movable by a first polishing-unit moving mechanism (not illustrated), and the second polishing unit 25B is movable by a second polishing-unit moving mechanism (not illustrated). These first and second polishing-unit moving mechanisms have the same configuration as that of the above-described polishing-unit moving mechanism 30.

Different types of polishing tapes can be used for the first polishing unit 25A and the second polishing unit 25B. For example, rough polishing of the substrate W may be performed in the first polishing unit 25A and finish polishing of the substrate W may be performed in the second polishing unit 25B. Moreover, the first positioning unit 90A may conduct alignment between the pressing member 51 and the polishing tape 38 in the polishing unit 25A and the second positioning unit 90B may conduct alignment between the pressing member 51 and the polishing tape 38 in the polishing unit 25B. These first and second positioning units 90A and 90B have the same configuration as the positioning unit 90 described above.

Figure 28:
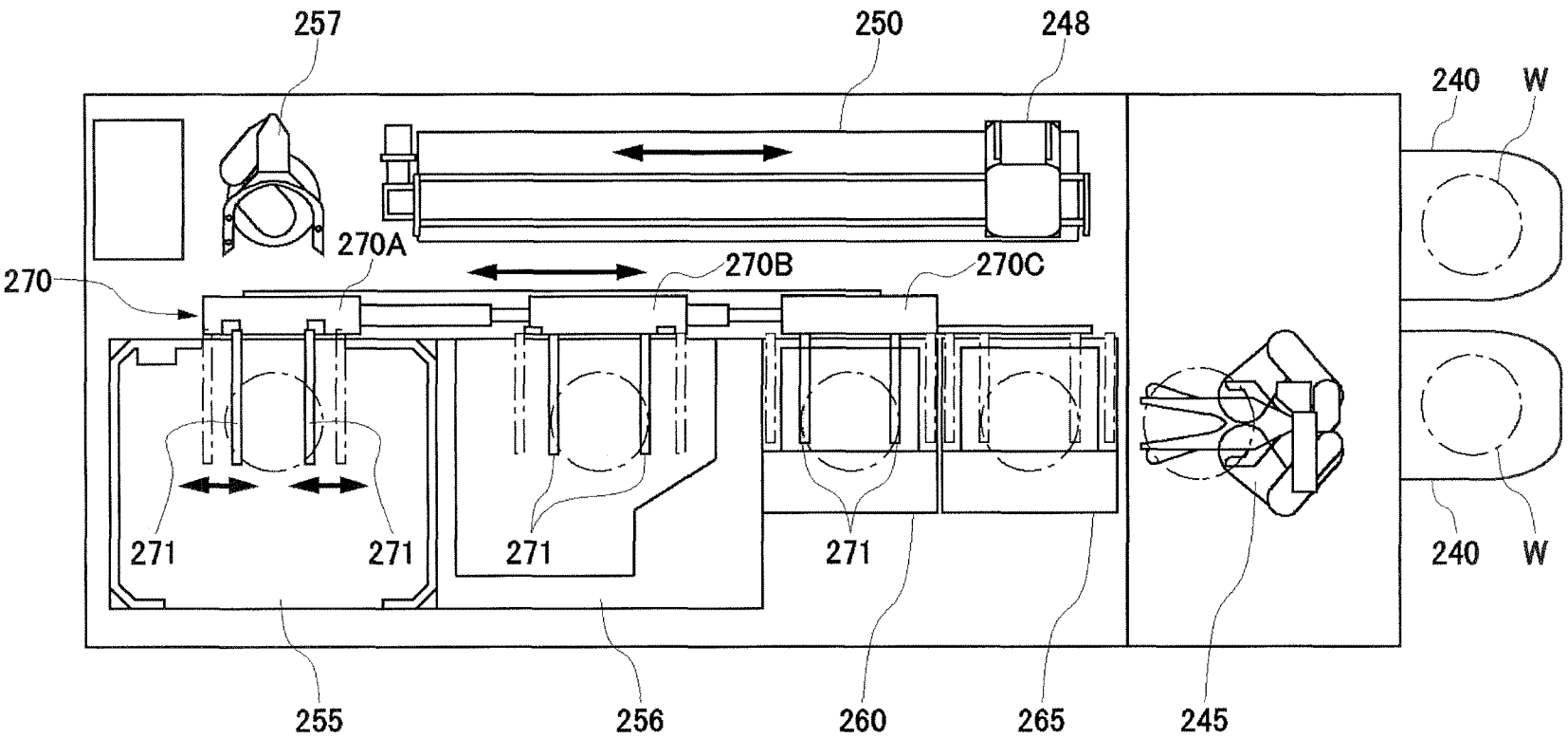
FIG. 28 is a top view of a substrate processing apparatus having a plurality of substrate processing modules including a polishing module according to an embodiment.

FIG. 28 is a top view of a substrate processing apparatus having a plurality of substrate processing modules including a polishing module. As illustrated in FIG. 28, the substrate processing apparatus includes two loading ports 240 configured to introduce the substrate W into the substrate processing apparatus, a first transport robot 245 configured to remove the substrate W from wafer cassettes (not illustrated in the drawing) on the loading ports 240, a notch aligner 248 configured to detect the position of a notch portion of the substrate W and to rotate the substrate W such that the notch portion of the substrate W is in a predetermined position, a notch-aligner moving mechanism 250 configured to move the notch aligner 248, a notch polishing module (a first polishing module) 255 configured to polish the notch portion of the substrate W, a second transport robot 257 configured to transport the substrate W from the notch aligner 248 to the notch polishing module 255, a top-edge polishing module (a second polishing module) 256 configured to polish the top edge portion of the substrate W, a cleaning module 260 configured to clean the polished substrate W, a drying module 265 configured to dry the cleaned substrate W, and a transporting mechanism 270 configured to transport the substrate W from the notch polishing module 255 to the top-edge polishing module 256, the cleaning module 260, and the drying module 265 successively in this order.

A conventional notch polishing apparatus, such as one disclosed in Japanese Patent Application Laid-Open No. 2009-154285, can be used as the notch polishing module 255. The above-described polishing apparatus illustrated in FIG. 5 or 26 can be used as the top-edge polishing module 256. The cleaning module 260 may be a roll-sponge type cleaning device that is configured to bring rotating roll sponges into contact with the upper surface and the lower surface of the rotating substrate W while supplying liquid onto the substrate W. The drying module 265 may be a spin drying device configured to rotate the substrate W at high speed.

The notch polishing module 255, the top-edge polishing module 256, the cleaning module 260, and the drying module 265 (hereinafter, these modules will be collectively referred to as substrate processing modules) are arranged in a line. The transporting mechanism 270 is arranged along an arrangement direction of these substrate processing modules. The transporting mechanism 270 has hand units 270A, 270B, and 270C. Each hand unit has a pair of hands 271 for holding the substrate W and is configured to transport the substrate W between the neighboring substrate processing modules. More specifically, the hand unit 270A is operable to remove the substrate W from the notch polishing module 255 and transport the same to the top-edge polishing module 256, and the hand unit 270B is operable to remove the substrate W from the top-edge polishing module 256 and transport the same to the cleaning module 260. The hand unit 270C is operable to remove the substrate W from the cleaning module 260 and transport the same to the drying module 265.

These hand units 270A, 270B, and 270C are movable linearly along the arrangement direction of the substrate processing modules. The hand units 270A, 270B, and 270C are configured to remove the substrates W from the substrate processing modules simultaneously, move simultaneously, and load the substrates W into the neighboring substrate processing modules simultaneously.

Next, an overall processing flow of the substrate W will be described. The first transport robot 245 removes the substrate W from the wafer cassette, and places the substrate W onto the notch aligner 248. The notch aligner 248 is moved together with the substrate W by the notch-aligner moving mechanism 250 to a position near the second transport robot 257. During this movement, the notch aligner 248 detects the position of the notch portion of the substrate W and rotates the substrate W such that the notch portion is in a predetermined position.

Then, the second transport robot 257 receives the substrate W from the notch aligner 248, and loads the substrate W into the notch polishing module 255. The notch portion of the substrate W is polished by the notch polishing module 255. The polished substrate W is transported to the top-edge polishing module 256, the cleaning module 260, and the drying module 265 successively in this order by the three hand units of 270A, 270B, and 270C of the transporting mechanism 270 as described above, so that the substrate W is processed in these substrate processing modules. The processed substrate W is transported by the first transport robot 245 into the wafer cassette on the loading port 240.

The notch polishing module 255 and the top-edge polishing module 256 are removably installed in the substrate processing apparatus. Therefore, it is possible to remove the notch polishing module 255 and/or the top-edge polishing module 256 and to install different type of polishing module in the substrate processing apparatus. For example, the polishing apparatus according to above-described embodiment that can polish the top edge portion of the substrate W may be used as the first polishing module, and a known bevel polishing apparatus that can polish the bevel portion of the substrate W may be used as the second polishing module.

In the above-described embodiment, although the pressing member 51 is also aligned using the positioning unit 90, the polishing tape 38 only may be aligned using the positioning unit 90 and the polishing head 50 including the pressing member 51 may be aligned according to another method. Moreover, in the above-described embodiment, the positioning unit 90 is on the lateral side of the substrate W and the polishing unit 25 moves to the polishing position by moving in the horizontal direction (the tangential direction) after realizing alignment between the pressing member 51 and the polishing tape 38 at the tape alignment position. However, the positioning unit 90 may be disposed above or below in the vertical direction of the substrate W and the polishing unit 25 may move up to the polishing position in the vertical direction after realizing alignment between the pressing member 51 and the polishing tape 38.

The description of the embodiments is provided to enable a person skilled in the art to implement the present technique. Moreover, various modifications of the embodiments can naturally be made by those skilled in the art, and the technical ideas of the present technique can be applied to other embodiments. Therefore, the present technique is not limited to the embodiments described herein but is to be interpreted in the broadest scope as defined by the claims.

According to the embodiments, since alignment of the polishing tape for allowing the polishing tape to be adsorbed to the pressing member is conducted according to a mechanical method of bringing the substrate-side edge of the polishing tape into contact with the contacting surface, it is possible to conduct alignment of the polishing tape without using an optical sensor in alignment of the polishing tape.

We claim:

1. A polishing method comprising:

providing a holding stage for holding and rotating a substrate;

providing a polishing head configured to hold a polishing tape and press the polishing tape by a pressing member against a peripheral portion of the substrate from above;

providing a first and second moving mechanism configured to move the polishing head and the polishing tape respectively and to adjust relative position between the polishing head and the polishing tape;

providing an alignment unit configured to align an edge of the pressing member and a tape edge of the polishing tape, the alignment unit including a positioning block having a contacting surface, the positioning block aligning the edge of the pressing member and the tape edge of the polishing tape by the contacting surface contacting the tape edge of the polishing tape and a side edge of the pressing member respectively when the first moving mechanism moves the polishing head and the second moving mechanism moves the polishing tape;

rotating the substrate;

aligning the edge of the pressing member and the tape edge of the polishing tape using the contacting surface of the positioning block contacting the side edge of the pressing member and the tape edge of the polishing tape respectively when the first moving mechanism moves the pressing member and the second moving mechanism moves the polishing tape; and pressing the polishing tape against a peripheral portion of the substrate using the pressing member to polish the peripheral portion of the substrate.

2. The polishing method according to claim 1, wherein the pressing member holds, by vacuum suction, the polishing tape in contact with the contacting surface of the positioning block after said aligning and before said pressing.

3. The polishing method according to claim 2, wherein after holding the polishing tape, moving the pressing member and the polishing tape to a polishing position in a state of holding by vacuum suction, the polishing tape to polish the peripheral portion of the substrate at the polishing position.

4. The polishing method according to claim 2, wherein a position of the pressing member is detected using a position sensor and the pressing member is moved to a position at which a gap corresponding to a tape allowance is formed between the edge of the pressing member and the contacting surface of the positioning block based on a detection value of the position sensor.

5. The polishing method according to claim 4, wherein during alignment, the pressing member holds, by vacuum suction, the polishing tape when the polishing tape is in contact with the contacting surface of the positioning block by vacuum suction in such a positional relation that the gap corresponding to the tape allowance is formed between the edge of the pressing member and the contacting surface of the positioning block.

* * * * *